US007643767B2

(12) United States Patent
Seto et al.

(10) Patent No.: US 7,643,767 B2
(45) Date of Patent: Jan. 5, 2010

(54) TRANSFER-FIXING UNIT AND IMAGE FORMING APPARATUS FOR ENHANCED IMAGE QUALITY

(75) Inventors: Takashi Seto, Yokohama (JP); Takeshi Takemoto, Yamato (JP); Takashi Fujita, Yokohama (JP); Katsuaki Miyawaki, Yokohama (JP); Hiromitsu Takagaki, Yokohama (JP); Shin Kayahara, Yokohama (JP); Atsushi Nakafuji, Tokyo (JP); Hiromi Tamura, Yokohama (JP); Kazumi Suzuki, Shizuoka (JP)

(73) Assignee: Ricoh Co., Ltd., Tokyo (JP)

( * ) Notice: Subject to any disclaimer, the term of this patent is extended or adjusted under 35 U.S.C. 154(b) by 480 days.

(21) Appl. No.: 11/681,739

(22) Filed: Mar. 2, 2007

(65) Prior Publication Data

US 2007/0212126 A1 Sep. 13, 2007

(30) Foreign Application Priority Data

| | | |
|---|---|---|
| Mar. 2, 2006 | (JP) | 2006-056158 |
| Mar. 20, 2006 | (JP) | 2006-075921 |
| Oct. 23, 2006 | (JP) | 2006-287318 |

(51) Int. Cl.
*G03G 15/01* (2006.01)

(52) U.S. Cl. ..... 399/66; 309/302; 309/308

(58) Field of Classification Search ..... 399/66, 399/307, 302, 308

See application file for complete search history.

(56) References Cited

U.S. PATENT DOCUMENTS

| | | | | |
|---|---|---|---|---|
| 4,068,937 | A * | 1/1978 | Willemse et al. | 399/308 |
| 4,799,084 | A * | 1/1989 | Koike et al. | |
| 5,402,220 | A | 3/1995 | Tanaka et al. | |
| 6,061,543 | A | 5/2000 | Kayahara et al. | |
| 6,324,374 | B1 | 11/2001 | Sasamoto et al. | |
| 6,345,170 | B1 | 2/2002 | Nakazato et al. | |

(Continued)

FOREIGN PATENT DOCUMENTS

| | | |
|---|---|---|
| JP | 63-189878 | 8/1988 |

(Continued)

OTHER PUBLICATIONS

U.S. Appl. No. 12/042,143, filed Mar. 4, 2008, Kayahara, et al.

(Continued)

*Primary Examiner*—Susan S Lee
(74) *Attorney, Agent, or Firm*—Oblon, Spivak, McClelland, Maier & Neustadt, L.L.P.

(57) ABSTRACT

A transfer unit for use in an image forming apparatus includes a transfer belt, and a counter member. The transfer belt, having a given circumferential length, receives an un-fixed image, formed of an image developer, from an image carrier at a first nip, which is defined between the transfer belt and the image carrier. The counter member faces the transfer belt to form a second nip with the transfer belt. The un-fixed image is transferred from the transfer belt to a recording medium passing through the second nip. A slack portion is generated in the transfer belt, when a front edge of the recording medium passes through the second nip. The slack portion of the transfer belt being generated in a first portion of the transfer belt returning from the second nip to the first nip.

20 Claims, 15 Drawing Sheets

U.S. PATENT DOCUMENTS

| | | | | |
|---|---|---|---|---|
| 6,631,253 | B2 | 10/2003 | Nakafuji et al. | |
| 6,697,595 | B2 | 2/2004 | Kawagoe et al. | |
| 6,795,678 | B2 | 9/2004 | Yura et al. | |
| 7,010,255 | B2 | 3/2006 | Yura et al. | |
| 7,031,648 | B2 | 4/2006 | Takashi et al. | |
| 7,054,585 | B2 | 5/2006 | Sasamoto et al. | |
| 7,127,202 | B2 | 10/2006 | Fujita et al. | |
| 2005/0002693 | A1* | 1/2005 | Pak et al. | 399/302 |
| 2005/0152721 | A1 | 7/2005 | Kikuchi et al. | |
| 2005/0201783 | A1 | 9/2005 | Kurotaka et al. | |
| 2005/0207801 | A1 | 9/2005 | Kunii et al. | |
| 2005/0286920 | A1 | 12/2005 | Baba et al. | |
| 2006/0008302 | A1 | 1/2006 | Someya et al. | |
| 2006/0013624 | A1 | 1/2006 | Kurotaka et al. | |
| 2006/0019082 | A1 | 1/2006 | Kikuchi et al. | |
| 2006/0140689 | A1 | 6/2006 | Echigo et al. | |
| 2008/0292346 | A1* | 11/2008 | Tsubaki | |

FOREIGN PATENT DOCUMENTS

| | | |
|---|---|---|
| JP | 04-109285 | 4/1992 |
| JP | 04-360179 | 12/1992 |
| JP | 05-224572 | 9/1993 |
| JP | 06-308839 | 11/1994 |
| JP | 09-258474 | 10/1997 |
| JP | 10-063121 | 3/1998 |
| JP | 10-268595 | 10/1998 |
| JP | 11-231677 | 8/1999 |
| JP | 2000-075750 | 3/2000 |
| JP | 2000-089601 | 3/2000 |
| JP | 2001-092274 | 4/2001 |
| JP | 2001-296764 | 10/2001 |
| JP | 2002-214930 | 7/2002 |
| JP | 2002-268325 | 9/2002 |
| JP | 2002-278311 | 9/2002 |
| JP | 2002-304080 | 10/2002 |
| JP | 2003-316176 | 11/2003 |
| JP | 2004-145260 | 5/2004 |
| JP | 2005-189693 | 7/2005 |
| JP | 2005-202113 | 7/2005 |
| JP | 2005-309227 | 11/2005 |

OTHER PUBLICATIONS

U.S. Appl. No. 12/164,921, filed Jun. 30, 2008, Suzuki et al.
U.S. Appl. No. 12/144,078, filed Jun. 23, 2008, Kayahara et al.
U.S. Appl. No. 12/144,267, filed Jun. 23, 2008, Yasutomi, et al.

* cited by examiner

TRANSFER-FIXING UNIT AND IMAGE FORMING APPARATUS FOR ENHANCED IMAGE QUALITY

CROSS-REFERENCE TO RELATED APPLICATIONS

This application claims priority from Japanese patent applications No. 2006-056158 filed on Mar. 2, 2006, No. 2006-075921 filed on Mar. 20, 2006, and No. 2006-287318 filed on Oct. 23, 2006 in the Japan Patent Office, the entire contents of which are hereby incorporated by reference herein.

TECHNICAL FIELD

The present disclosure relates to an image forming apparatus, and more particularly to an image forming apparatus having a transfer-fixing unit.

BACKGROUND

An image forming apparatus such as a copier, facsimile, and printer may produce an image-recorded sheet by fixing an image on a recording sheet. Such fixing may be conducted by applying heat and pressure to the recording sheet having an un-fixed image thereon.

Specifically, an image forming apparatus may include a fixing unit, to which a recording sheet having an un-fixed image thereon is transported to fix the un-fixed image on the recording sheet.

For example, the fixing unit may include a heating roller and a pressure roller to fix the un-fixed image on the recording sheet. The heating roller may apply heat to toner particles (or developing agent) included in the un-fixed image to melt toner particles. The melted toner particles may permeate into the recording sheet with an effect of the heating roller and pressure roller. With such fixing process, the fixing unit may fix the un-fixed image on the recording sheet. In general, such fixing unit may include a cleaning member to clean the heating roller, for example.

Conventionally, an image forming apparatus may include a photoconductor or an intermediate transfer belt, which may carry a toner image thereon. In such image forming apparatus, the toner image may be electrostatically transferred to a sheet from the photoconductor or intermediate transfer belt, and then the sheet may be transported to a fixing unit, in which the toner image may be fixed on the sheet to produce an image-recorded sheet.

In such a fixing unit, a sheet may enter and leave a fixing nip, defined between a heating roller and a pressure roller to fix the un-fixed image on the sheet.

Specifically, a front edge portion of sheet may enter and leave the fixing nip first, and a rear edge portion sheet may enter and leave the fixing nip last.

During such a fixing process, a rotational speed of heating roller or pressure roller may vary or fluctuate when the sheet enters and leaves the fixing nip.

In such a conventional fixing process, even if a heavy sheet (e.g., heavy paper), which may vary a rotational speed of rollers relatively greatly, enters and leaves the fixing nip, a rotational speed change of such rollers may not affect an image quality to be produced on the sheet.

In such a conventional fixing process, a rotational speed fluctuation of rollers may not affect an image quality when a front edge portion of a sheet enters the fixing nip or a rear edge portion of the sheet leaves the fixing nip.

However, an image forming apparatus having a following configuration may produce a lower quality image when such rotational speed fluctuation of rollers may occur in a fixing unit.

FIG. 1 shows an image forming section of an image forming apparatus having a plurality of photoconductors in a tandem manner.

As shown in FIG. 1, such an image forming section may include an intermediate transfer belt 2, a drive roller 9, a registration roller 18, a secondary transfer roller 71, a counter roller 71*a*, and a drive motor Mb, for example.

The secondary transfer roller 71 and counter roller 71A may define a secondary transfer nip TN2 therebetween, to which a sheet P or heavy sheet HP may be transported from the registration roller 18. The drive motor Mb may drive a traveling movement of the intermediate transfer belt 2.

In this disclosure, the sheet P may include a plurality of types of sheets, and the heavy sheet HP may indicate a thicker sheet such as heavy paper. The sheet P or heavy sheet HP may be used in this disclosure, as required.

When the sheet P enters or leaves the secondary transfer nip TN2, a load fluctuation may occur in a transportation direction of sheet P at the secondary transfer nip TN2.

Such a load fluctuation may be transmitted to the drive roller 9 via the intermediate transfer belt 2.

The drive roller 9 has a shaft, which may be linked to a drive motor Mb via a link mechanism or speed reduction mechanism. The drive motor Mb may include a DC (direct current) motor, a pulse motor, or the like.

As shown in FIG. 1, the intermediate transfer belt 2 may be extended by the drive roller 9. The intermediate transfer belt 2 may travel in a given direction with a driving force of the drive roller 9, which may frictionally move the intermediate transfer belt 2.

The drive motor Mb and drive roller 9 may be used to control a traveling movement of the intermediate transfer belt 2 precisely.

If a load fluctuation occurring at the secondary transfer nip TN2 is not adjusted by the drive roller 9, such load fluctuation may cause a deviation of traveling amount of intermediate transfer belt 2 from a normal traveling amount although such a deviational amount may be of a tiny scale Such a traveling amount deviation may be transmitted to a primary transfer nip TN1 defined by a photoconductor (e.g., photoconductor drum) and the intermediate transfer belt 2, and then a deviation of image transfer position from a normal position may occur at such primary transfer nip TN1.

Such a deviation of an image transfer position at the primary transfer nip TN1 may be termed as shock jitter, which may be a deviational movement of a tiny scale.

If such shock jitter may occur, an image quality to be produced on a recording sheet may be degraded.

Furthermore, a condition of the drive roller 9 and other driving force transmission mechanism, which controls a traveling movement of intermediate transfer belt 2, may also be affected by several factors.

For example, such factors may include a smaller scale slipping of intermediate transfer belt 2 due to load fluctuation, an elongation of intermediate transfer belt 2 due to load fluctuation, deformation of gears included in a link mechanism or speed reduction mechanism, and a driving force degradation of drive motor Mb due to load fluctuation.

Recently, some image forming apparatuses may have been employing a transfer-fixing configuration, which may conduct an image transfer and fixing process in a seamless manner. Such a configuration may be preferable from a viewpoint of miniaturization of an apparatus and improvement of sheet transportation reliability.

However, in such transfer-fixing method, a shock jitter may unfavorably become greater when a sheet enters and leaves a nip defined by transfer-fixing configuration.

If such greater shock jitter occurs, such shock jitter may affect an image quality to be produced on a sheet.

Specifically, a shock jitter may occur when a front edge portion or rear edge portion of sheet P may pass through a fixing nip for transfer-fixing configuration. Such shock jitter may unfavorably become greater when the sheet P is a heavy sheet (or heavy paper).

Such shock jitter may occur at the primary transfer nip TN1 when a load fluctuation occurring at the fixing nip in a transfer-fixing configuration is transmitted to a secondary transfer nip TN2, and then to the primary transfer nip TN1 via the intermediate transfer belt 2.

A fixing nip pressure in such transfer-fixing configuration may generally be set to a greater value than a secondary transfer nip pressure at the secondary transfer nip TN2 shown in FIG. 1, by which an effect of shock jitter may become relatively greater.

Accordingly, such relatively greater shock jitter may degrade an image quality to be produced on a sheet, wherein such degradation may be observed as "banding (e.g., unintended stripe-like image)" on a sheet.

FIGS. 2A and 2B show a schematic configuration for measuring a speed fluctuation at a nip portion such as secondary transfer nip by using the registration roller 18 and a measuring roller 50.

The measuring roller 50 may be provided in a position corresponding to a secondary transfer nip.

FIG. 2A shows a timing when a front edge portion of the sheet P enters the measuring roller 50, and FIG. 2B shows a timing when a rear edge portion of the sheet P leaves the measuring roller 50.

Based on actual testing results conducted with a configuration shown in FIGS. 2A and 2B, it has been learned that a speed fluctuation of a sheet transport speed at the measuring roller 50 may be observed when a front edge portion of the sheet P enters the measuring roller 50, and a rear edge portion of the sheet P leaves the measuring roller 50. Such a speed fluctuation may become greater if a heavy paper is used as the sheet P.

FIG. 3 shows an example chart explaining a measurement result of a speed fluctuation experiment conducted using a configuration shown in FIGS. 2A and 2B.

In FIG. 3, signals Pi and Po may respectively correspond to conditions shown in FIGS. 2A and 2B. As shown in FIG. 3, a heavy sheet (or heavy paper) may cause a relatively greater speed fluctuation when the heavy sheet passes through a nip portion, which is not favorable from a viewpoint of shock jitter.

SUMMARY

The present disclosure relates to a transfer unit for use in an image forming apparatus. The transfer unit includes a transfer belt, and a counter member. The transfer belt, having a given circumferential length, receives an un-fixed image, formed of an image developer, from an image carrier at a first nip, which is defined between the transfer belt and the image carrier. The counter member faces the transfer belt to form a second nip with the transfer belt. The un-fixed image is transferred from the transfer belt to a recording medium passing through the second nip. A slack portion is generated in the transfer belt, when a front edge of the recording medium passes through the second nip. The slack portion of the transfer belt being generated in a first portion of the transfer belt returning from the second nip to the first nip.

The present disclosure also relates to an image forming apparatus including a transfer unit, which includes a transfer belt, and a counter member. The transfer belt, having a given circumferential length, receives an un-fixed image, formed of an image developer, from an image carrier at a first nip, which is defined between the transfer belt and the image carrier. The counter member faces the transfer belt to form a second nip with the transfer belt. The un-fixed image is transferred from the transfer belt to a recording medium passing through the second nip. A slack portion is generated in the transfer belt, when a front edge of the recording medium passes through the second nip. The slack portion of the transfer belt being generated in a first portion of the transfer belt returning from the second nip to the first nip.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
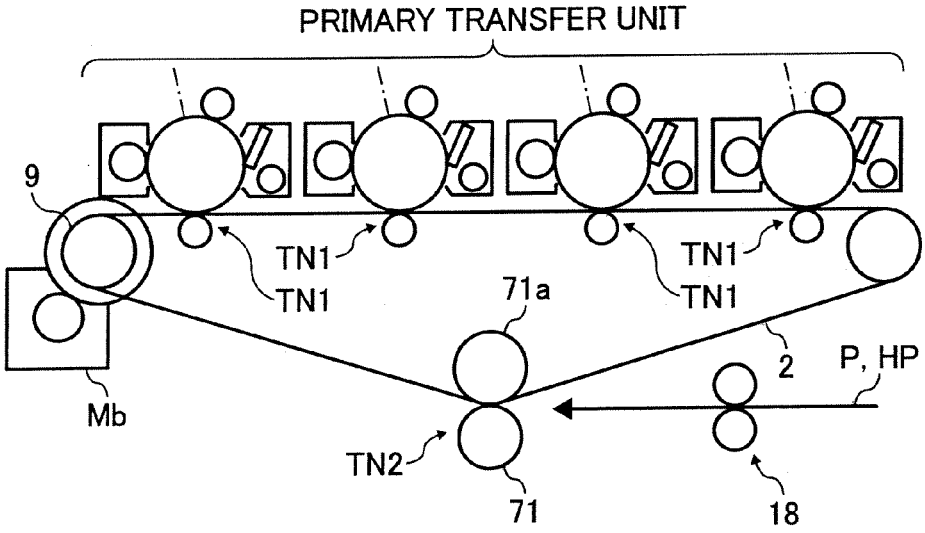
FIG. 1 is an example configuration of image forming apparatus having photoconductors in tandem manner, in which an image is transferred to a sheet at secondary transfer nip.
Figure 2A:
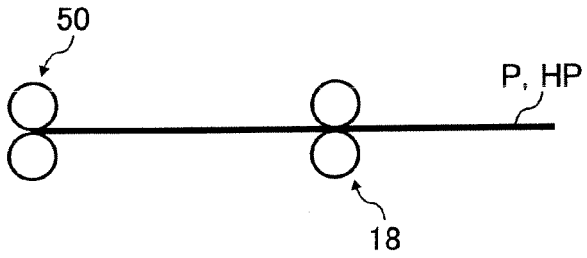
FIGS. 2A and 2B show an example configuration for measuring a speed fluctuation of a roller.
Figure 2B:
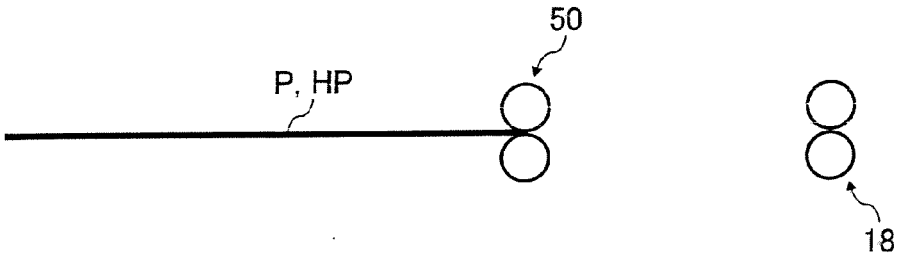
Figure 3:
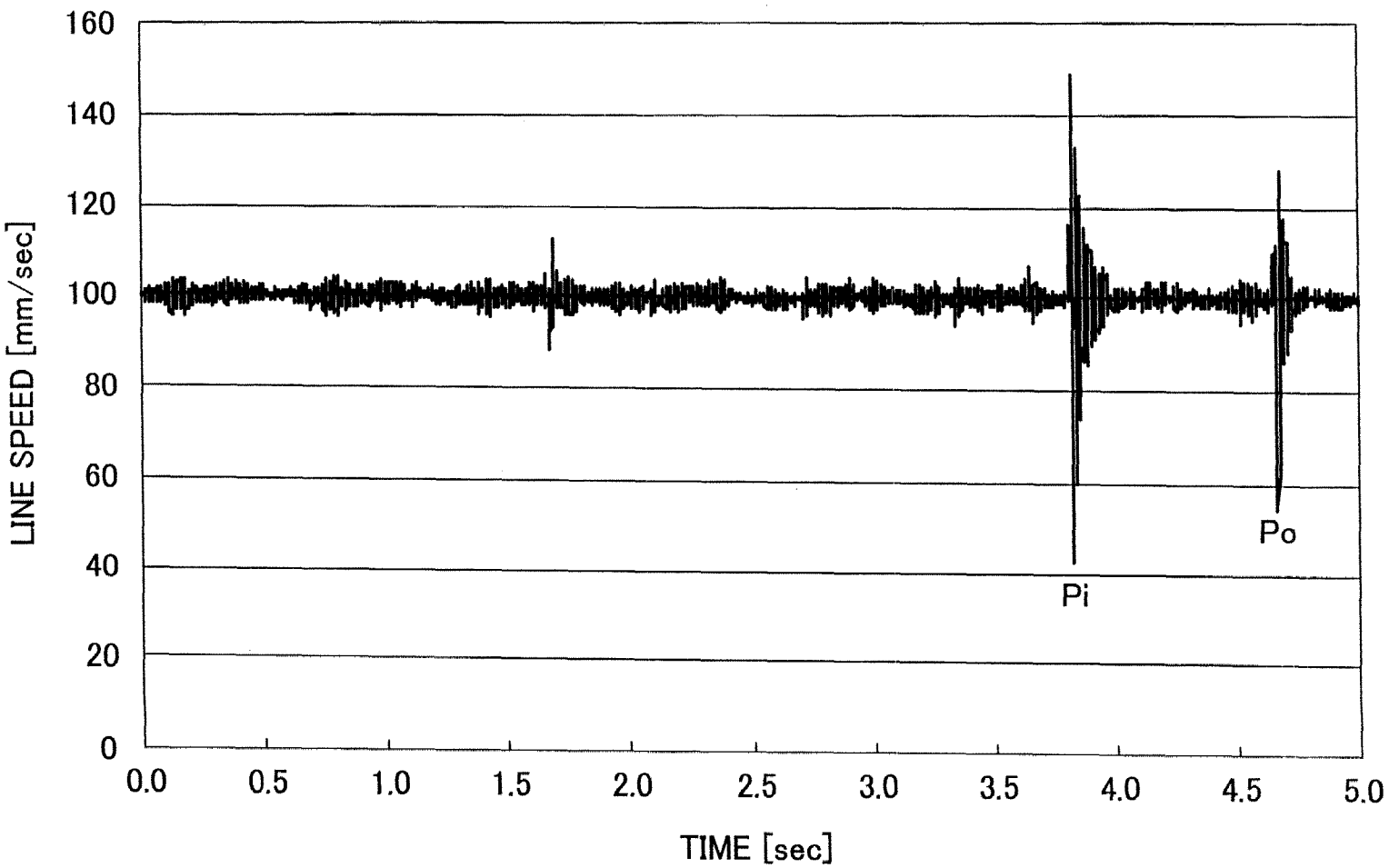
FIG. 3 shows an example chart for a measurement result of speed fluctuation of a roller.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 4:
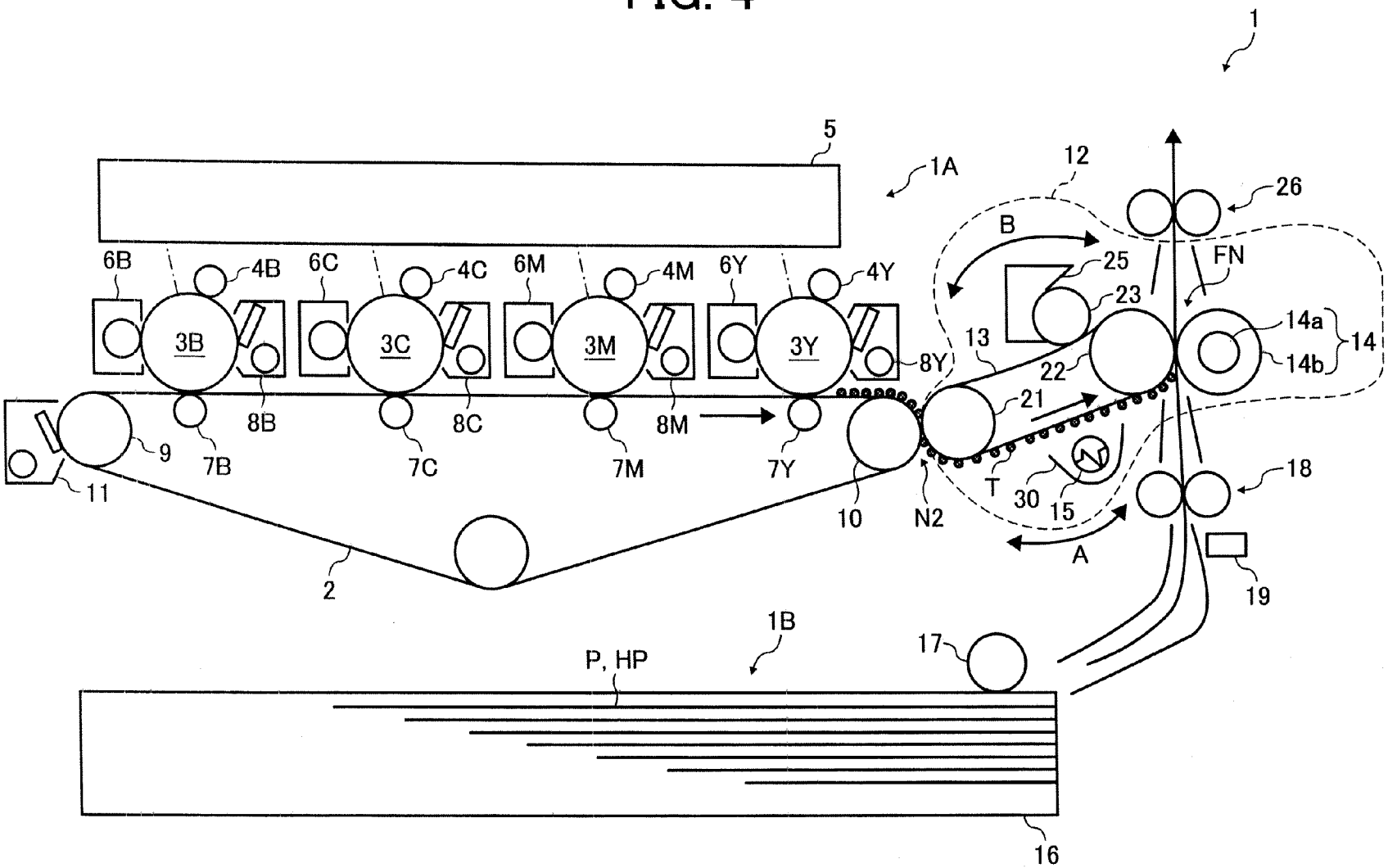
FIG. 4 is an example configuration of an image forming apparatus according to an example embodiment.

Referring now to the drawings, wherein like reference numerals designate identical or corresponding parts throughout the several views, a transfer-fixing unit for use in an image forming apparatus according to an example embodiment is described with particular reference to FIG. 4.

FIG. 4 shows an image forming apparatus 1 according to an example embodiment, in which photoconductors may be arranged in a tandem manner.

As shown in FIG. 4, the image forming apparatus 1 may include an intermediate transfer belt 2, a photoconductor 3 (e.g., 3B, 3C, 3M, and 3Y), a charger 4 (e.g., 4B, 4C, 4M, and 4Y), a writing unit 5, a developing unit 6 (e.g., 6B, 6C, 6M, and 6Y), a primary transfer unit 7 (e.g., 7B, 7C, 7M, and 7Y), a cleaning unit 8 (e.g., 8B, 8C, 8M, and 8Y), a drive roller 9, a secondary transfer roller 10 (as driven roller), a belt cleaning unit 11, a transfer-fixing unit 12, a transfer-fixing belt 13, a pressure roller 14, a sheet container 16, a feed roller 17, a registration roller 18, a registration sensor 19, a secondary transfer roller 21, a transfer-fixing roller 22, a cleaning roller 23, a scraper 25, an ejection roller 26, and a reflection plate 30, for example, The sheet container 16 may contain recording medium. The recording medium may include any types of sheet-like material used for the image forming apparatus 1 such as film, paper, or the like. Hereinafter, the recording medium may be referred to "sheet P" or "heavy sheet HP." The "sheet P" may mean any type of sheet-like material and the "heavy sheet HP" may mean any type of sheet-like material having a relatively greater thickness.

The image forming apparatus 1 may be configured and operated as explained below. The image forming apparatus 1 may include a color printer, but not limited to the color printer.

As shown in FIG. 4, the image forming apparatus 1 may be composed of three sections: an image forming section 1A, a sheet feed section 1B, and an image-scanning section (not shown).

The sheet feed section 1B may be provided below the image forming section 1A, and the image-scanning section (not shown) may be provided over the image forming section 1A, for example.

As shown in FIG. 4, the image forming section 1A may include the intermediate transfer belt 2 as intermediate transfer member, which may extend in a horizontal direction, and the photoconductors 3Y, 3M, 3C, and 3B provided over the intermediate transfer belt 2.

Reference characters of Y, M, C, and B may correspond to yellow, magenta, cyan, and black respectively in this disclosure.

Each of the photoconductors 3Y, 3M, 3C, and 3B may carry respective color image (e.g., toner image of yellow, magenta, cyan, and black) thereon, and may transfer such color image to a surface of the intermediate transfer belt 2. Each of the photoconductors 3Y, 3M, 3C, and 3B may be drum shaped, and may rotate in a given direction (e.g., counter-clockwise direction), for example.

Hereinafter, the photoconductors 3Y, 3M, 3C, and 3B may be collectively termed as "photoconductor 3Y" or "photoconductor 3," as required because the photoconductors 3Y, 3M, 3C, and 3B may take a similar configuration to one another.

As shown in FIG. 4, the photoconductor 3 may be surrounded with the charger 4, the writing unit 5, the developing unit 6, the primary transfer unit 7, and the cleaning unit 8, all of which may be used for image forming operation.

Each developing unit 6 may contain yellow, magenta, cyan, and black toners, respectively.

As shown in FIG. 4, the drive roller 9 and secondary transfer roller 10 may extend the intermediate transfer belt 2. The secondary transfer roller 10 may be a driven roller, for example.

As shown in FIG. 4, the belt cleaning unit 11 may be provided on a position facing the drive roller 9 via the intermediate transfer belt 2, at which the belt cleaning unit 11 may clean the surface of intermediate transfer belt 2.

The charger 4 may uniformly charge a surface of the photoconductor 3Y.

Then, the charged surface of the photoconductor 3Y may be irradiated by a light beam, which may come from the writing unit 5 so that an electrostatic latent image may be formed on the photoconductor 3Y. Such light beam may be generated based on image information scanned by an image-scanning section (not shown).

Then, the developing unit 6Y may develop the electrostatic latent image on the photoconductor 3Y as a toner image with yellow toner stored in the developing unit 6Y.

Then, the toner image may be transferred to the intermediate transfer belt 2 from the photoconductor 3Y by the primary transfer unit 7Y. The primary transfer unit 7Y may be applied with a given bias voltage from a power source (not shown) to transfer the toner image from the photoconductor 3Y to the intermediate transfer belt 2.

The above-explained image forming process may be similarly conducted on other photoconductors 3M, 3C, and 3B using respective color toner.

Then, each toner image formed on each of the photoconductors 3Y, 3M, 3C, and 3B may be transferred onto the intermediate transfer belt 2 sequentially and superimposingly.

After transferring the toner image to the intermediate transfer belt 2, toner particles remaining on the photoconductor 3 may be removed by the cleaning unit 8.

Then, a de-charger (not shown) may de-charge the photoconductor 3, by which the photoconductor 3 may be ready for a next image forming operation.

As shown in FIG. 4, the transfer-fixing unit 12 may be provided at a position facing the secondary transfer roller 10.

As shown in FIG. 4, the transfer-fixing unit 12 may include a transfer-fixing belt 13, a secondary transfer roller 21, a transfer-fixing roller 22, and a pressure roller 14, for example. The transfer-fixing belt 13 may be used as transfer-fixing member.

The transfer-fixing belt 13 may receive a toner image from the intermediate transfer belt 2, and then transfer the toner image to the sheet P. Accordingly, the toner image may exist on the transfer-fixing belt 13 as un-fixed toner image.

As shown in FIG. 4, the secondary transfer roller 21 in the transfer-fixing unit 12 may define a secondary transfer nip N2 with the secondary transfer roller 10 in the intermediate transfer belt 2.

The transfer-fixing roller 22 may drive a traveling movement of the transfer-fixing belt 13.

The pressure roller 14 may face the transfer-fixing roller 22 via the transfer-fixing belt 13.

Such pressure roller 14, transfer-fixing roller 22, and transfer-fixing belt 13 may define a fixing nip FN as shown in FIG. 4. The pressure roller 14 may apply pressure to the sheet P at the fixing nip FN.

The transfer-fixing belt 13 may be composed of a base layer, an elastic layer, and a separation layer, for example.

Specifically, the base layer may be made of resinous material such as polyimide having a given thickness such as 100 μm. The elastic layer, made of rubber such as silicone rubber, may be formed on the base layer. The separation layer may be coated on the elastic layer as surface layer. The separation layer may be made of a resinous material such as PFA (perfluoroalkoxy).

As shown in FIG. 4, a heater 15 (e.g., halogen heater) and a reflection plate 30 may be provided near the transfer-fixing belt 13 to heat a toner image transported on the transfer-fixing belt 13.

The heater 15 (e.g., halogen heater) and reflection plate 30 may be provided inside or outside of the transfer-fixing belt 13 depending on a design concept.

As shown in FIG. 4, the pressure roller 14 may include a metal core 14*a* and an elastic layer 14*b* made of rubber, for example.

As shown in FIG. 4, the sheet feed section 1B may include the sheet container 16, the feed roller 17, and the registration roller 18, for example.

The sheet container 16 may stack and contain the sheet P or heavy sheet HP as above mentioned.

Hereinafter, the sheet P may include any types of sheet including heavy sheet HP. However, the term of "heavy sheet HP" may be used in the following description, as required.

The feed roller 17 may feed the sheet P from the sheet container 16 to the registration roller 18 one by one from a top sheet in the sheet container 16.

The registration roller 18 may temporarily stop the sheet P to correct an orientation of sheet P. During a transportation of sheet P in a transportation route to the registration roller 18, an orientation of sheet P may be deviated from a normal orientation. For example, an orientation of sheet P may be slanted with respect to the transportation route. The registration roller 18 may correct such orientation error of the sheet P.

Then, the registration roller 18 may feed the sheet P to the fixing nip FN by synchronizing a timing of transporting a toner image on the transfer-fixing belt 13 to the fixing nip FN and a timing of feeding the sheet P to the fixing nip FN.

Such sheet feed timing may be controlled using the registration sensor 19, provided in an upstream side of sheet transportation route with respect to the registration roller 18, for example.

As shown in FIG. 4, an ejection roller 26 may be provided in a downstream side of sheet transportation route with respect to the fixing nip FN. The ejection roller 26 may eject the sheet P to an outside of the image forming apparatus 1.

As above explained, a toner image T may be primary transferred to the intermediate transfer belt 2 from the photoconductor 3Y, 3M, 3C, and 3B.

Then, the secondary transfer roller 10 may secondary transfer the toner image T to the transfer-fixing belt 13 from the intermediate transfer belt 2.

The secondary transfer roller 10 may be applied with a bias voltage from a bias voltage applier (not shown). The bias voltage may include a superimposed current composed of alternative current (AC), pulse current, for example.

Such secondary transferability of toner image T may be preferably conducted by setting a preferable level of contacting condition between the intermediate transfer belt 2 and transfer-fixing belt 13.

For example, the secondary transfer roller 10 may have a roller bearing (not shown) at both shaft end of the secondary transfer roller 10.

A spring may apply a biasing force to such roller bearing (not shown) of the secondary transfer roller 10 to press the secondary transfer roller 10 toward the transfer-fixing belt 13.

The toner image T. transferred on the transfer-fixing belt 13 from the intermediate transfer belt 2, may be heated on the transfer-fixing belt 13 until the toner image T may be fixed on the sheet P at the fixing nip FN.

In other words, a preliminary heating of the toner image T may be efficiently conducted on the transfer-fixing belt 13 with such configuration until the toner image T is transported to the fixing nip FN.

With such configuration for preliminary heating of the toner image T while the toner image T is transported on the transfer-fixing belt 13, a heating temperature at the fixing nip FN may be preferably decreased compared to a heating temperature at a fixing nip of a conventional heating configuration.

In general, a conventional heating configuration at a fixing nip may heat a toner image and a sheet at a substantially same time.

Based on an experiment, it has been confirmed that the image forming apparatus 1 can produce an image having a preferable image quality while setting a temperature of the transfer-fixing belt 13 at a relatively lower temperature. For example, the temperature of the transfer-fixing belt 13 may be set from 110° C. to 120° C.

A conventional image forming apparatus (e.g., color printer) may apply a relatively larger amount of heat to a fixing nip to effectively produce a glossy image on a sheet by considering a temperature-decreasing effect by a sheet at the fixing nip.

For example, an amount of heat applied to a fixing nip in an full-color image forming apparatus (e.g., color printer) may be increased about fifty percent compared to an amount of heat applied to a fixing nip in a monochrome image forming apparatus.

However, such relatively larger heat amount may excessively heat a sheet. Furthermore, in order to fix a toner image on such excessively heated sheet, a contacting level of a toner image and sheet may need to be increased to an excessively higher level.

On one hand, in an example configuration according to an example embodiment, the image forming apparatus 1 may set a relatively lower temperature for effectively fixing a glossy image on a sheet with the above-described configuration having the transfer-fixing belt 13.

Specifically, the image forming apparatus 1 may set a relatively lower temperature for the transfer-fixing belt 13, and also a relatively lower temperature for effectively fixing a glossy image on a sheet.

As such, the image forming apparatus 1 may set such relatively lower temperature to the transfer-fixing belt 13 and the fixing nip FN independently from a condition of the sheet P.

Furthermore, because the toner image T may be effectively heated on the transfer-fixing belt 13 before the toner image T is transported to the fixing nip FN, the sheet P may not need to be heated to a excessively higher temperature at the fixing nip FN.

In other word, the sheet P may be heated to a relatively lower temperature in a configuration according to an example embodiment.

With such a configuration capable of lowering a temperature setting for a fixing operation, a contacting level of the toner image T and the sheet P may be set to a relatively lower level.

Preferably, such a transfer-fixing configuration may conduct a fixing operation at relatively lower temperature, may decrease a warming-up time period, and may decrease an energy consumption amount of the image forming apparatus 1.

Furthermore, such a transfer-fixing configuration may preferably reduce an amount of heat transfer from the transfer-fixing belt 13 to the intermediate transfer belt 2, by which a durability of the intermediate transfer belt 2 (as intermediate transfer member) may be enhanced.

Specifically, such a transfer-fixing configuration may decrease a temperature of the intermediate transfer belt 2, by which a thermal degradation of the intermediate transfer belt 2 may be reduced.

As explained above, in an example configuration according to an example embodiment, the transfer-fixing unit 12 may be used as a "transfer-fixing unit."

Such a "transfer-fixing unit" may include a function of receiving an un-fixed toner image from an image carrier (e.g., intermediate transfer belt 2), and may conduct a transferring and fixing process of the un-fixed toner image to a sheet at a fixing nip in a substantially concurrent manner.

Accordingly, such a "transfer-fixing unit" may be different from a conventional fixing unit, which may simply apply heat and pressure to a sheet, already having un-fixed toner image thereon, at a fixing nip.

Figure 5A:
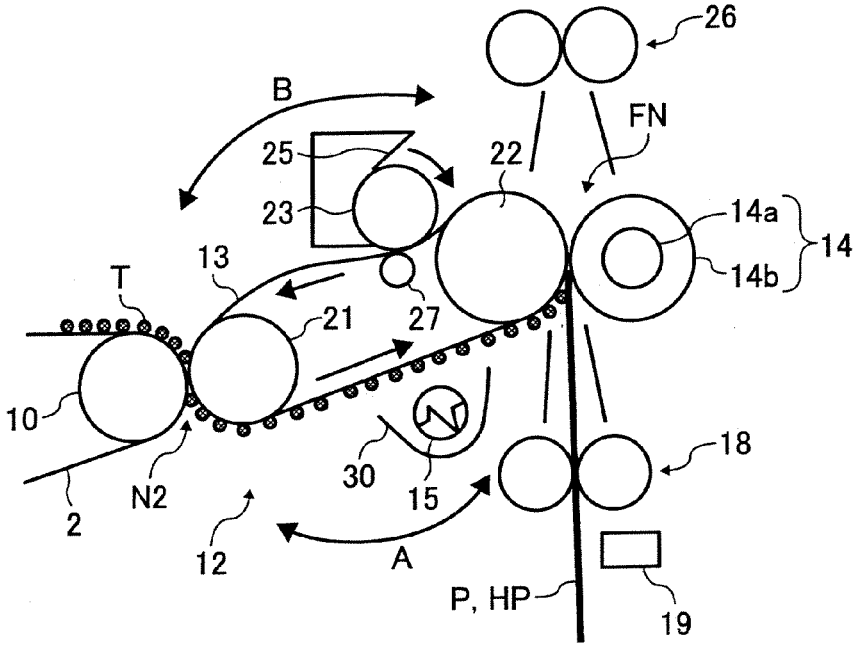
FIG. 5A is an example configuration for reducing a shock jitter when a sheet enters a fixing nip of a transfer-fixing unit.

FIG. 5A is an expanded view of a transfer-fixing configuration of the image forming apparatus 1 according to an example embodiment. FIG. 5A shows an example configuration for reducing a shock jitter, which may occur when a sheet such as heavy paper enters a fixing nip.

The transfer-fixing belt 13 may travel in a given direction (e.g., counter-clockwise direction in FIG. 5A) with an effect of rotational movement of the transfer-fixing roller 22, which may be driven by a drive motor (not shown).

As shown in FIG. 5A, a cleaning roller 23 and a pressure roller 27 may be provided in a zone B of transfer-fixing configuration.

The zone B may be an upper side of the transfer-fixing configuration, and may be from the fixing nip FN to the secondary transfer nip N2 as shown in FIG. 5A.

A zone A may be a lower side of the transfer-fixing configuration, and may be from the secondary transfer nip N2 to the fixing nip FN as shown in FIG. 5A.

In the zone B, the transfer-fixing belt 13 may travel from the fixing nip FN to the secondary transfer nip N2 as shown in FIG. 5A.

In the zone A, the transfer-fixing belt 13 may travel from the secondary transfer nip N2 to the fixing nip FN as shown in FIG. 5A.

As shown in FIG. 5A, the cleaning roller 23 may contact the transfer-fixing belt 13, and may rotate in a same direction with the transfer-fixing belt 13 at such contacted portion.

The transfer-fixing belt 13, driven by the transfer-fixing roller 22, may have a line speed V, and the cleaning roller 23 may have a rotating speed V1, which may be set faster than the line speed V.

With such different speed setting, the transfer-fixing belt 13 may receive a frictional effect from the cleaning roller 23 at the contacted portion of the transfer-fixing belt 13 and cleaning roller 23.

As shown in FIG. 5A, the support roller 27 may be provided in an opposite position of the cleaning roller 23 via the transfer-fixing belt 13, and may contact the transfer-fixing belt 13 as shown in FIG. 5A.

The support roller 27 may be rotated with a traveling movement of the transfer-fixing belt 13, and may apply a pressure to the transfer-fixing belt 13 so that the transfer-fixing belt 13 may receive a frictional effect from the cleaning roller 23 at a preferable level.

The support roller 27 may apply a pressure to the transfer-fixing belt 13 with a biasing member (not shown) such as spring or the like attached to the support roller 27, for example.

Furthermore, instead of the support roller 27, a relatively smaller elastic member (e.g., leaf spring) may be used to apply pressure to the transfer-fixing belt 13.

Such a smaller biasing member may be fixed near the transfer-fixing belt 13 to apply a smaller frictional effect to the transfer-fixing belt 13.

During a cleaning process by the cleaning roller 23, toner particles remaining on the transfer-fixing belt 13 may be transferred to the cleaning roller 23 from the transfer-fixing belt 13, and then may be removed by a scraper 25. Then, such removed toner particles may be recovered to a collecting unit (not shown).

As shown in FIG. 5A, the transfer-fixing belt 13 may be extended by two rollers of the secondary transfer roller 21 and the transfer-fixing roller 22. Such transfer-fixing belt 13 may have a given circumferential length.

Figure 5B:
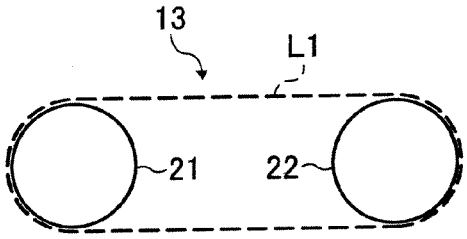
FIGS. 5B and 5C show an example configuration for transfer-fixing belt, in which lengths of a transfer-fixing belt are compared.

If the transfer-fixing belt 13 may be extended tightly by the secondary transfer roller 21 and the transfer-fixing roller 22, the transfer-fixing belt 13 may have a first circumferential length L1, which is shown as dotted line in FIG. 5B.

Figure 5C:
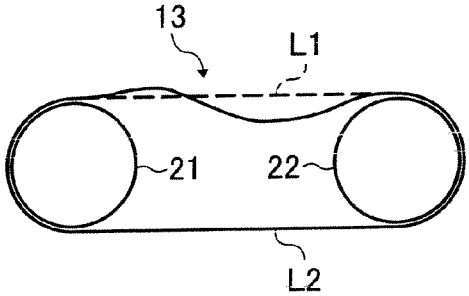

However, in an example configuration according to an example embodiment, the transfer-fixing belt 13 may have a second circumferential length L2, which is shown as solid line in FIG. 5C. Such second circumferential length L2 may be set slightly longer than the circumferential length L1.

Accordingly, the transfer-fixing belt 13, extended by the secondary transfer roller 21 and the transfer-fixing roller 22, may have a slack portion in the zone B as shown in FIG. 5A, for example.

As above-explained, the cleaning roller 23 may rotate with the rotating speed V1, set faster than the line speed V of the transfer-fixing belt 13, in the zone B (i.e., from the cleaning roller 23 to the secondary transfer roller 21), and the transfer-fixing belt 13 may have the second circumferential length L2.

Accordingly, a first belt portion of the transfer-fixing belt 13, which may exist in the zone B, may be traveled at a relatively faster speed compared to a second belt portion of the transfer-fixing belt 13, which may not exist in the zone B.

With such different speed on the transfer-fixing belt 13, the transfer-fixing belt 13 may have a slack portion in the zone B (i.e., from cleaning roller 23 to secondary transfer roller 21) as shown in FIG. 5A.

When the heavy sheet HP (e.g., heavy paper) may enter the fixing nip FN defined by the pressure roller 14 and transfer-fixing roller 22, the heavy sheet HP may resultantly apply a force to the pressure roller 14 and transfer-fixing roller 22.

In general, the pressure roller 14 and transfer-fixing roller 22 may apply a relatively higher pressure to each other at the fixing nip FN.

When the heavy sheet HP may enter such fixing nip FN, the heavy sheet HP may push the transfer-fixing roller 22 for some level so that the heavy sheet HP can enter the fixing nip FN, which may be a tiny space.

Because the pressure roller 14 and transfer-fixing roller 22 may apply a relatively higher pressure to each other at the fixing nip FN, the heavy sheet HP may need to be inserted into the fixing nip FN in a push-like manner.

Such push-like insertion may cause a load increase to the pressure roller 14 and transfer-fixing roller 22, by which a rotational speed of the transfer-fixing roller 22 may be decreased for a moment.

During such push-like insertion, the secondary transfer roller 21 may not receive an effect of such relatively greater force occurred at the fixing nip FN.

Therefore, during such push-like insertion, the secondary transfer roller 21 may rotate with a speed, which may be different from a rotational speed of the transfer-fixing roller 22.

Accordingly, if the transfer-fixing belt 13 is tightly extended between the secondary transfer roller 21 and the transfer-fixing roller 22 as shown in FIG. 5B, such rotational speed difference between the secondary transfer roller 21 and transfer-fixing roller 22 may cause the above-mentioned shock jitter at a primary transfer nip of photoconductor 3.

In an example configuration according to an example embodiment, a rotational speed of the transfer-fixing roller 22 may be decreased when the heavy sheet HP may enter the fixing nip FN.

However, the transfer-fixing belt 13 may have a slack portion between the cleaning roller 23 and secondary transfer roller 21 as above explained with FIG. 5A.

The secondary transfer roller 21 may rotate at a normal rotational speed during an insertion of heavy sheet HP, and the secondary transfer roller 21 may move the transfer-fixing belt 13 with a length corresponding to a normal rotational speed of the secondary transfer roller 21.

In order to travel the transfer-fixing belt 13 in a normal manner, a next length of belt corresponding to the length of belt moved by the secondary transfer roller 21 may need to come to the secondary transfer roller 21.

If the transfer-fixing belt 13 may not have a slack portion between the cleaning roller 23 and secondary transfer roller 21, such next length of belt may not come to the secondary transfer roller 21.

In an example configuration according to an example embodiment, the transfer-fixing belt 13 may have a slack portion between the cleaning roller 23 and secondary transfer roller 21, by which such next length of belt may come to the secondary transfer roller 21.

Accordingly, the transfer-fixing belt 13 may be moved in a substantially normal manner even if the heavy paper HP may enter the fixing nip FN in the transfer-fixing unit 12.

Accordingly, a shock jitter may not occur at the primary transfer nip of photoconductor 3 because an effect of load fluctuation at the fixing nip FN may not be transmitted to the primary transfer nip of photoconductor 3 via the secondary transfer nip N2 and intermediate transfer belt 2.

In an example configuration according to an example embodiment, the secondary transfer roller 21 may be set as driven roller, which may be rotated by the transfer-fixing roller 22 (as drive roller) via the transfer-fixing belt 13.

The secondary transfer roller 21 may also be set as drive roller, which may rotate with a substantially similar speed of the transfer-fixing roller 22, and such secondary transfer roller 21 may have an over-run clutch, for example.

Figure 6:
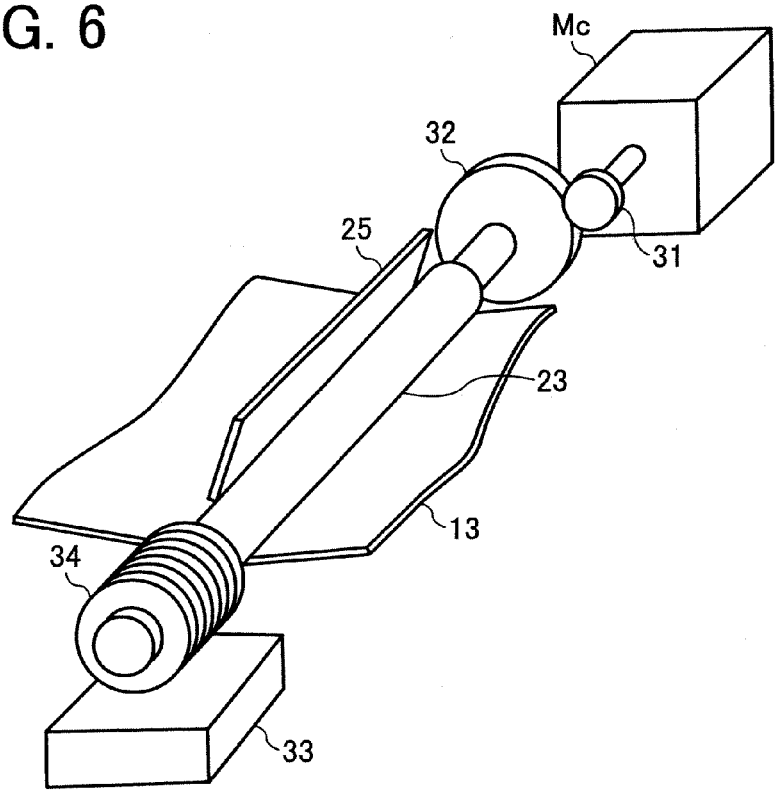
FIG. 6 is an example configuration for a cleaning roller, also used as a cooling roller.

FIG. 6 shows an example configuration for the cleaning roller 23. The cleaning roller 23 may also be used as cooling roller for cooling the transfer-fixing belt 13. Accordingly, a term of "cleaning roller 23 (as cooling roller)" may be used, as required.

The cleaning roller 23 (as cooling roller) may have a micro-heat pipe structure, which may be used for cooling a CPU (central processing unit) of personal computer, to maintain the cleaning roller 23 at a relatively lower temperature.

As shown in FIG. 6, a configuration for the cleaning roller 23 may include a motor gear 31, a driven gear 32, a cooling fan 33, a cooling fin 34, and a cleaning motor Mc, for example.

In case of a transfer-fixing method, a heated transfer-fixing belt 13 may transfer heat to the intermediate transfer belt 2 via the secondary transfer nip N2. Then, the intermediate transfer belt 2 may transfer heat to the photoconductor 3.

Accordingly, compared to a conventional fixing method, the photoconductor 3 may have a relatively higher temperature condition. Such higher temperature condition of the photoconductor 3 may result into degradation of developability and transferability of toner images.

Such heat transfer may be preferably reduced or suppressed by providing a cooling roller at position where the transfer-fixing belt 13 has come out of the fixing nip FN after transferring the toner image T to the sheet P.

In an example embodiment, the cleaning roller 23 may also be used as cooling roller, for example.

As shown in FIG. 6, the cleaning roller 23 (as cooling roller) may have one shaft end, at which the driven gear 32 may be attached. The driven gear 32 may be meshed with the motor gear 31 of the cleaning motor Mc.

Accordingly, the cleaning roller 23 (as cooling roller) may be rotated with a driving force of the cleaning motor Mc.

As shown in FIG. 6, the cleaning roller 23 (as cooling roller) may be contacted to the scraper 25 to remove and recover toner particles remaining on the cleaning roller 23, wherein such remaining toner particles may be transferred to the cleaning roller 23 from the transfer-fixing belt 13.

The cleaning roller 23 (as cooling roller) may be made of a metal material having greater heat conductivity such as copper and aluminum.

As shown in FIG. 6, the cleaning roller 23 (as cooling roller) may have another shaft end, at which the cooling fin 34 may be attached. The cooling fin 34 may contact with the cooling fan 33. With such cooling fan 33 and cooling fin 34, heat accumulated in the cleaning roller 23 (as cooling roller) may be dissipated.

Figure 7:
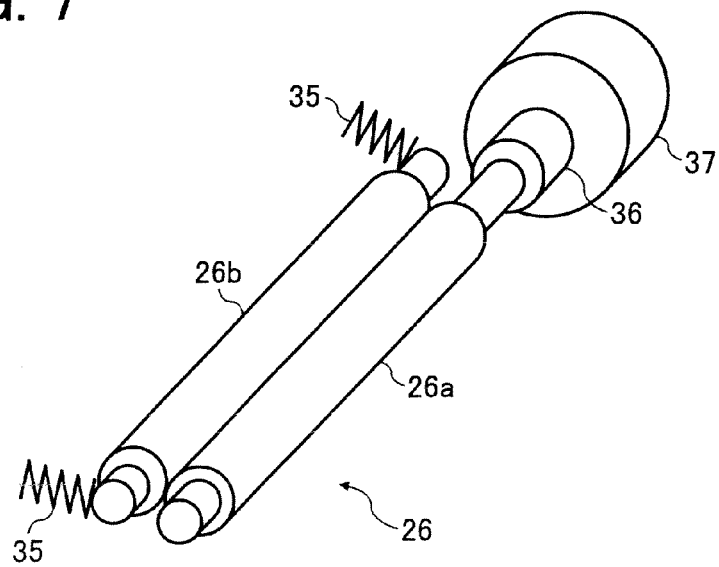
FIG. 7 is an example configuration of an ejection roller.

FIG. 7 shows an example configuration for the ejection roller 26.

Such configuration may include a spring 35, a coupling 36, an electromagnetic brake 37, and ejection rollers 26*a* and 26*b*, for example.

The ejection rollers 26*a* and 26*b* may be collectively termed "ejection roller 26," and the ejection roller 26*a*, ejection roller 26*b*, and ejection roller 26 may be used, as required.

As shown in FIG. 7, the ejection roller 26*b* may have a shaft end, fitted in a bearing (not shown). The spring 35 may apply a biasing force to the shaft end of the ejection roller 26*b* via the bearing (not shown). Then, the ejection roller 26*b* may be biased to the ejection roller 26*a* with the spring 35.

The ejection roller 26 may include a surface layer. The surface layer may be made of a rubber material such as urethane, EPDM (ethylene propylene diene monomer), and silicone.

The surface layer may also be made of a metal-including layer having a higher friction coefficient, which may be made by adding or melting metal powder, ceramics or the like. Such surface layer may have a rough surface.

As shown in FIG. 7, the ejection roller 26*a* has a shaft end coupled to the electromagnetic brake 37 via the coupling 36. The electromagnetic brake 37 may cause a brake torque to the ejection roller 26*a* based on an electric power input to the electromagnetic brake 37.

When the sheet P may enter a space between the ejection rollers 26*a* and 26*b*, a transportation movement of the sheet P may rotate the ejection rollers 26*a* and 26*b*.

When the electromagnetic brake 37 may be applied with an electric power, the electromagnetic brake 37 may cause a brake torque to the ejection roller 26*a*, by which a transportation speed of sheet P may be decreased.

Hereinafter, a condition when the sheet P passes through the fixing nip FN is explained with reference to FIGS. 8 and 9.

Figure 8:
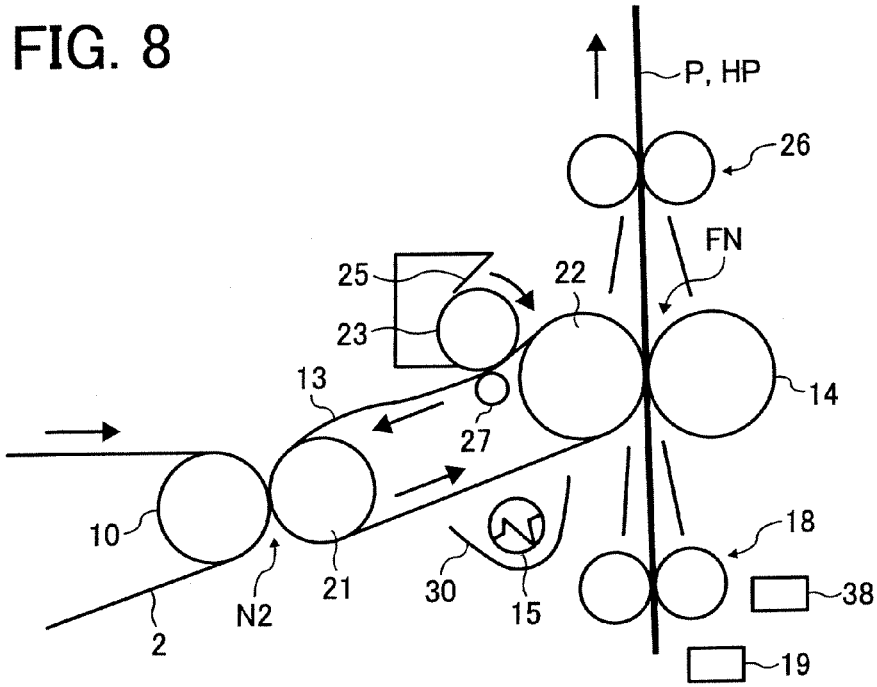
FIG. 8 is a schematic view of a transfer-fixing unit when a rear edge portion of sheet passes through a registration sensor.

FIG. 8 shows a condition when the sheet P is passing through the fixing nip FN.

Specifically, FIG. 8 shows a condition that a front edge portion of the sheet P has already passed through the fixing nip FN and ejection roller 26, and a rear edge portion of the sheet P is just passing through the registration sensor 19.

As shown in FIG. 8, a sheet thickness sensor 38 may be provided near the registration roller 18. Specifically, the sheet thickness sensor 38 may be provided near a pressure-applying roller of the registration roller 18.

The sheet thickness sensor 38 may include a laser displacement sensor, eddy-current displacement sensor, a contact sensor, for example.

The sheet thickness sensor 38 may measure a sheet thickness of sheet P by measuring a displacement amount of the pressure-applying roller of the registration roller 18 when the sheet P enters the registration roller 18.

The registration sensor 19 may detect a rear edge portion of sheet P when the sheet P is transported in a transportation route, and the sheet thickness sensor 38 may detect a sheet thickness of sheet P when the sheet P is passing through the registration roller 18.

The sheet P shown in FIG. 8 may be under a condition that the sheet P is sandwiched by the ejection roller 26, and the fixing nip FN.

In such a condition, the electromagnetic brake 37 coupled to the ejection roller 26*a* may be in a power-OFF condition. Therefore, the ejection roller 26 may rotate with a transportation movement of the sheet P.

Such transportation movement of the sheet P may be generated by a driving force of the transfer-fixing roller 22 at the fixing nip FN. In other words, the sheet P may receive a sheet transportation force from the transfer-fixing roller 22.

Figure 9:
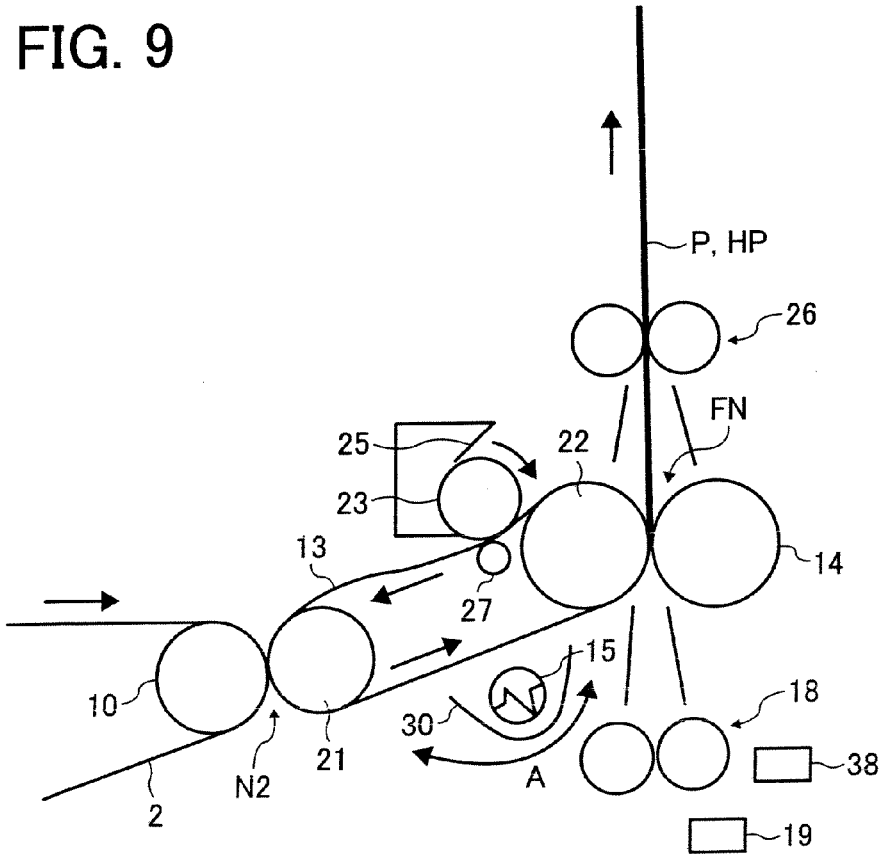
FIG. 9 is a schematic view of a transfer-fixing unit when a rear edge portion of sheet passes through a fixing nip.

FIG. 9 shows a condition when a rear edge portion of sheet P has just passed through the fixing nip FN.

Such pass-through timing of rear edge portion of sheet P may be measured based on a reference timing when the registration sensor 19 detects the rear edge portion of sheet P.

At such pass-through timing of rear edge portion of sheet P, the electromagnetic brake 37 may be applied with an electric power, and the electromagnetic brake 37 may cause a brake torque to the ejection roller 26*a*, by which a transportation speed of the sheet P may be decreased.

When the sheet P is in the fixing nip FN, the transfer-fixing roller 22 may receive a relatively greater pressure because of the existence of the sheet P in the fixing nip FN, which may be a tiny space.

Therefore, when the sheet P leaves the fixing nip FN, the transfer-fixing roller 22 may be released from such relatively greater pressure.

Accordingly, a traveling speed of the transfer-fixing belt 13 may increase for a moment because the transfer-fixing roller 22, released from such relatively greater pressure, can rotate freely.

At such pass-through timing of a rear edge portion of sheet P, a transportation speed of sheet P can be decreased with the above-explained configuration having the ejection roller 26 and electromagnetic brake 37.

Specifically, by slowing down the transportation speed of sheet P as such, a speed fluctuation of the transfer-fixing belt 13 may be reduced or suppressed by using a stiffness of the sheet P, which is just leaving the fixing nip FN.

With such a configuration, a speed fluctuation of the transfer-fixing belt 13 may not be transmitted to the primary transfer nip of photoconductor 3 via the secondary transfer nip N2 and intermediate transfer belt 2.

Therefore, a shock jitter, which may cause a negative effect to image processing at the primary transfer nip of photoconductor 3, may be preferably reduced or suppressed.

Furthermore, a level of voltage (or electric power) to be applied to the electromagnetic brake 37 may be adjusted depending on a thickness of sheet P, which may be detected by the sheet thickness sensor 38.

For example, a voltage (or electric power) to be applied to the electromagnetic brake 37 may be proportionally increased with a thickness of sheet P to increase brake torque to be caused to the ejection roller 26*a*.

In other words, the thicker the thickness of sheet P, the greater the voltage (or electric power) to be applied to the electromagnetic brake 37, for example.

With such a controlling method, a relatively greater speed fluctuation of the transfer-fixing belt 13 caused by a thicker sheet (e.g., heavy paper) may be effectively and efficiently reduced or suppressed.

Such voltage (or electric power) adjusting may be digitally controlled. For example, such voltage (or electric power) adjusting may be controlled by simply using ON/OFF signals.

However, such simple controlling method using ON/OFF signals may not concurrently control a pass-through timing of the sheet P at the fixing nip FN and a voltage-applying timing to the electromagnetic brake 37 in a precise manner.

If the pass-through timing of the sheet P and the voltage-applying timing to the electromagnetic brake 37 are not matched to each other in a precise manner, a speed fluctuation of the transfer-fixing belt 13 may not be reduced or suppressed.

Accordingly, in an example embodiment, a voltage controller (not shown) may adjust voltage (or electric power) in a manner mixing an analog-like controlling to a digital controlling.

For example, the voltage controller (not shown) may gradually increase a voltage level to be applied to the electromagnetic brake 37 before the sheet P passes through the fixing nip FN at the pass-through timing of the sheet P. by which the rotating speed of the ejection roller 26 may be gradually decreased before the sheet P may pass through the fixing nip FN.

Then, the voltage controller (not shown) may gradually decrease a voltage level to be applied to the electromagnetic brake 37 after the pass-through timing of the sheet P. by which the rotating speed of the ejection roller 26 may be gradually increased after the sheet P may pass through the fixing nip FN.

Such a gradual speed control method may be preferable because a precise matching of the pass-through timing of the rear edge portion of sheet P and the voltage-applying timing to the electromagnetic brake 37 may not be required.

Furthermore, such a gradual speed control method may preferably reduce or suppress a speed fluctuation of the transfer-fixing belt 13 even if the pass-through timing of the rear edge portion of sheet P and the voltage-applying timing to the electromagnetic brake 37 may not be matched to each other in a precise manner.

Instead of the electromagnetic brake 37, another driver such as a motor (not shown) may be coupled to the ejection roller 26 to control a rotation of the ejection roller 26.

Figure 10:
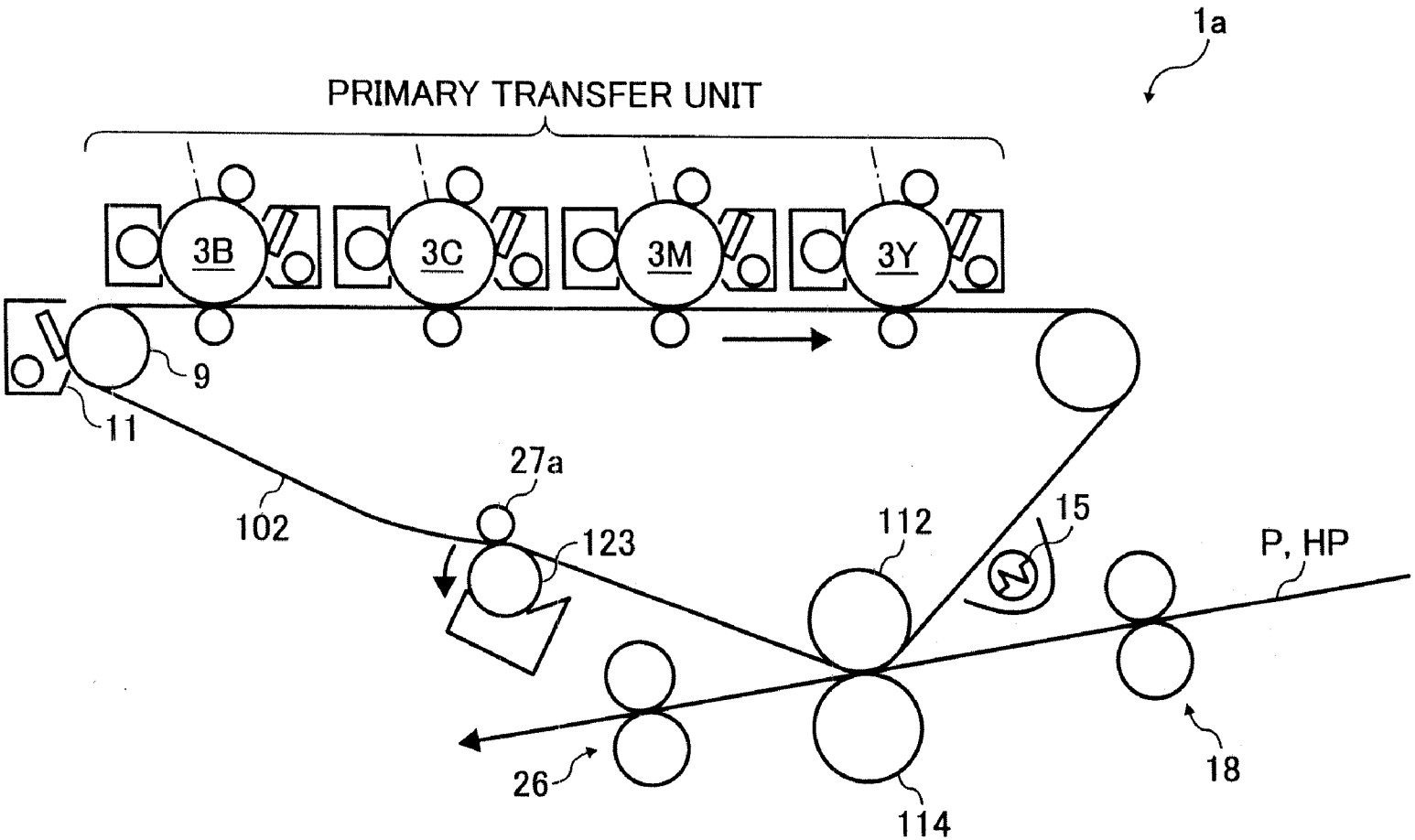
FIG. 10 shows another configuration according to an example embodiment, in which a transfer-fixing process is conducted at a secondary transfer nip.

FIG. 10 shows another example configuration of an image forming apparatus 1*a* according to an example embodiment.

As shown in FIG. 10, the image forming apparatus la may include a transfer-fixing belt 102, a transfer-fixing roller 112, a pressure roller 114, and a cleaning roller 123, and a support roller 27*a* for cleaning roller 123, for example.

In the image forming apparatus 1*a*, a toner image may be transferred on the transfer-fixing belt 102 from the photoconductor 3. Such toner image transferred on the photoconductor 3 may be heated by the heater 15 (e.g., halogen heater).

Then, such a heated toner image may be transported to a transfer-fixing nip defined by the transfer-fixing roller 112 and the pressure roller 114 to transfer and fix the toner image onto the sheet P.

Then, the sheet P may be ejected from the image forming apparatus 1by the ejection roller 26.

In an example configuration explained with FIGS. 4 to 9, a transfer-fixing unit (e.g., transfer-fixing belt 13) may be provided in addition to an intermediate transfer member (e.g., intermediate transfer belt 2) to conduct a transfer-fixing process.

On one hand, in another example configuration explained with FIG. 10, an intermediate transfer member (e.g., transfer-fixing belt 102) may also function as transfer-fixing unit to conduct a transfer-fixing process.

Accordingly, a transfer-fixing process according to an example embodiment may be applied to any type of transfer nip for transferring a toner image from an image carrier (e.g., intermediate transfer belt) to the sheet P.

Furthermore, in the above-explained embodiments, the heater 15 (e.g., halogen heater) may be omitted, as required.

Figure 11:
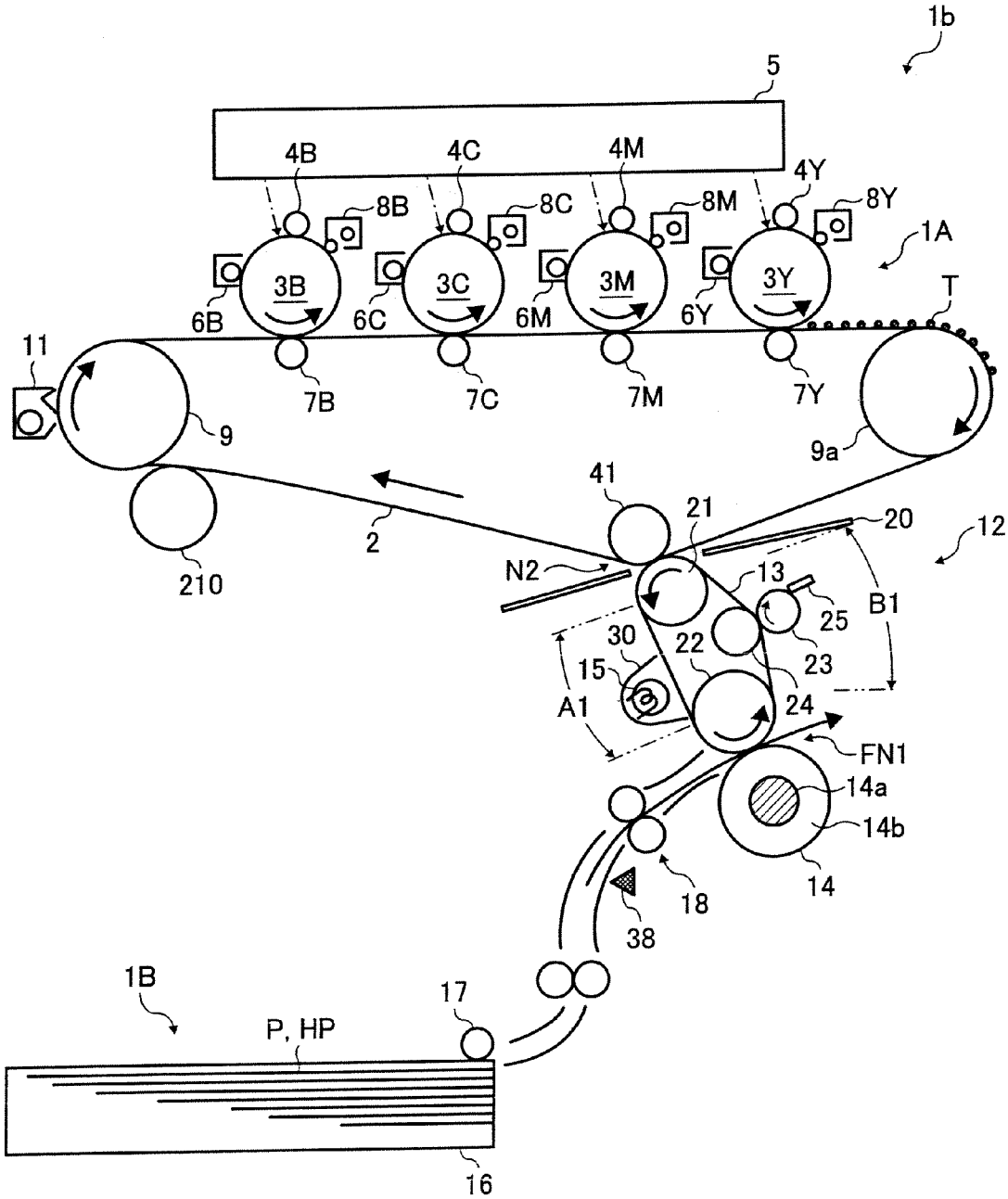
FIG. 11 is another example configuration of an image forming apparatus according to an example embodiment.

FIG. 11 shows another example configuration of an image forming apparatus 1*b* according to an example embodiment.

The image forming apparatus 1 shown in FIG. 4 and the image forming apparatus 1*b* shown in FIG. 11 may have a similar configuration, which may be understandable by comparing FIGS. 4 and 11.

Accordingly, the image forming apparatus 1*b* shown in FIG. 11 is explained by mainly describing a part or operation, which may be different from the image forming apparatus 1 shown in FIG. 4.

In another example configuration shown in FIG. 11, the drive roller 9, a driven roller 9*a*, and a secondary transfer roller 41 may extend the intermediate transfer belt 2.

A secondary transferability (e.g., efficiency and effectiveness of transfer) of the intermediate transfer belt 2 and transfer-fixing belt 13 may be set to a preferable level by setting a contacting level of the intermediate transfer belt 2 and transfer-fixing belt 13 at a preferable level.

In an example configuration shown in FIG. 11, a secondary transfer roller 41 may be used to set a contacting level of the intermediate transfer belt 2 and transfer-fixing belt 13 at a preferable level.

The secondary transfer roller 41 may have a shaft end (not shown), which may be fitted to a roller bearing. A spring (not shown) may apply a pressure to the roller bearing so that the secondary transfer roller 41 may press the intermediate transfer belt 2 toward the transfer-fixing belt 13.

As shown in FIG. 11, a heat insulating plate 20 may be provided between the intermediate transfer belt 2 and the transfer-fixing belt 13 to reduce or suppress a heat effect to the intermediate transfer belt 2 from the transfer-fixing belt 13.

In other words, the heat insulating plate 20 may reduce or suppress a heat transfer from the transfer-fixing belt 13 to the intermediate transfer belt 2. Such heat insulating plate 20 may be used as a heat transfer suppressor.

The heat insulating plate 20 may have a given size of opening portion, which may be a slit-like portion, for example.

The intermediate transfer belt 2 may transfer (e.g., secondary transfer) a toner image to the transfer-fixing belt 13 through the opening portion of the heat insulating plate 20.

The given size of an opening portion of the heat insulating plate 20 may be set to a size that may reduce a heat effect to the intermediate transfer belt 2 as much as possible and also may not hinder a transfer process from the intermediate transfer belt 2 to the transfer-fixing belt 13.

As shown in FIG. 11, an image transfer process from the intermediate transfer belt 2 to the transfer-fixing belt 13 may be conducted with a secondary transfer roller 41 provided in the intermediate transfer belt 2 and the secondary transfer roller 21 provided in the transfer-fixing belt 13.

The heat insulating plate 20 may be provided at a given position in the image forming apparatus 1*b* based on a design concept.

The insulating plate 20 may be preferably made of a metal plate having a relatively lower emissivity and glossy surface. Specifically, the insulating plate 20 may be preferably made of two metal sheets stacked by setting a tiny space therebetween, or two metal sheets stacked by putting an insulating material therebetween.

Furthermore, the heat insulating plate 20 may include a thin plate having a micro-heat pipe structure, which may be used for cooling a CPU (central processing unit) of personal computer, to maintain the heat insulating plate 20 (as heat transfer suppressor) at a relatively lower temperature and to reduce or suppress a heat transfer.

Furthermore, as shown in FIG. 11, a cooling roller 210 may be provided at a position between the secondary transfer roller 41 and drive roller 9, for example.

The cooling roller 210 may be made of a material having greater heat conductivity, and may contact the intermediate transfer belt 2. The cooling roller 210 may rotate to absorb heat from the intermediate transfer belt 2.

The cooling roller 210 may preferably decrease a temperature of the intermediate transfer belt 2, and thereby a heat degradation of the intermediate transfer belt 2 may be reduced or suppressed.

Furthermore, if such configuration for decreasing a temperature of the intermediate transfer belt 2 may be employed, a number of design ideas for a configuration around a transfer-fixing member (e.g., transfer-fixing unit 12) can be increased because the intermediate transfer belt 2 may be cooled by the above-explained configuration using the cooling roller 210.

In another example configuration shown in FIG. 11, both of the heat insulating plate 20 and cooling roller 210 may be provided for the image forming apparatus 1*b*. However, the image forming apparatus 1*b* may be provided with at least one of the heat insulating plate 20 and cooling roller 210.

Hereinafter, another example configuration for reducing a shock jitter according to an example embodiment is explained with reference to FIG. 11.

As shown in FIG. 11, a cleaning roller 23 and a counter roller 24 may be provided in the transfer-fixing unit 12. The counter roller 24 may be provided inside the transfer-fixing belt 13.

The cleaning roller 23 may include a heat-insulating layer (not shown). Accordingly, a heating time for heating the whole transfer-fixing unit 12 may be preferably reduced.

The cleaning roller 23 may remove toner particles remaining on the transfer-fixing belt 13. The cleaning roller 23 may rotate at a higher speed than a fixing roller (e.g., transfer-fixing roller 22).

The transfer-fixing belt 13, driven by the transfer-fixing roller 22, may have a line speed V, and the cleaning roller 23 may have a rotating speed V1, which may be set faster than the line speed V.

With such a different speed setting, the transfer-fixing belt 13 may receive a frictional effect from the cleaning roller 23 at a contacted portion of the transfer-fixing belt 13 and cleaning roller 23.

The transfer-fixing belt 13 shown in FIG. 11, extended by the secondary transfer roller 21 and the transfer-fixing roller 22, may have a slack portion in a zone B1 in FIG. 11 in a similar manner explained with FIG. 5.

As similar to a case explained with FIG. 5, a circumferential length of the transfer-fixing belt 13 has a length, which may be set slightly longer than a total length composed of straight lines extended between the rollers 21, 22, and 24.

With such setting of circumferential length of the transfer-fixing belt 13, the transfer-fixing belt 13 may have a slack portion.

Such a slack portion of the transfer-fixing belt 13 may be provided between a fixing nip FN1, defined by the transfer-fixing roller 22 and pressure roller 14, and a secondary transfer nip N2, defined by the secondary transfer rollers 41 and 21.

Specifically, such slack portion of the transfer-fixing belt 13 may be provided in the zone B1, in which the transfer-fixing belt 13 may not have a toner image thereon because the transfer-fixing belt 13 may have already transferred the toner image to the sheet P at the fixing nip FN1.

Because the slack portion of the transfer-fixing belt 13 may be provided to a portion having no toner image, such slack portion may not affect an image forming operation conducted by the transfer-fixing unit 12.

Toner particles remaining on transfer-fixing belt 13 may be transferred to the cleaning roller 23, and then may be scraped and recovered by the scraper 25.

In such another example configuration shown in FIG. 11, because the cleaning roller 23 may have the rotating speed V1, which may be set faster than the line speed V for the transfer-fixing belt 13, driven by the transfer-fixing roller 22, a first belt portion of the transfer-fixing belt 13, which may exist in the zone B1, may be traveled at a relatively faster speed compared to a second belt portion of the transfer-fixing belt 13, which may not exist in the zone B1.

Specifically, with such traveling speed difference within the transfer-fixing belt 13, a slack portion may be generated between the cleaning roller 23 to the secondary transfer roller 21 in the zone B1.

When the heavy sheet HP (e.g., heavy paper) may enter the fixing nip FN1, the heavy sheet HP may apply a force to the pressure roller 14 and transfer-fixing roller 22.

The pressure roller 14 and transfer-fixing roller 22 may apply a relatively higher pressure to each other at the fixing nip FN1.

When the heavy sheet HP may enter such fixing nip FN1, the heavy sheet HP may push the transfer-fixing roller 22 for some level so that the heavy sheet HP can enter a tiny space of the fixing nip FN1.

Because the pressure roller 14 and transfer-fixing roller 22 may apply a relatively higher pressure to each other at the fixing nip FN1, the heavy sheet HP may need to be inserted into the tiny space of the fixing nip FN1 in a push-like manner.

Such a push-like insertion may cause a load increase to the pressure roller 14 and transfer-fixing roller 22, by which a rotational speed of the transfer-fixing roller 22 may be decreased for a moment.

In another example configuration shown in FIG. 11, the transfer-fixing belt 13 may have a slack portion between the cleaning roller 23 and secondary transfer roller 21 as above explained.

The secondary transfer roller 21 may rotate at a normal rotational speed during an insertion of heavy sheet HP, and the secondary transfer roller 21 may move the belt with a length corresponding to a normal rotational speed of the secondary transfer roller 21.

In order to travel the transfer-fixing belt 13 in a normal manner, a next length of belt corresponding to the length of belt moved by the secondary transfer roller 21 may need to come to the secondary transfer roller 21.

If the transfer-fixing belt 13 does not have a slack portion between the cleaning roller 23 and secondary transfer roller 21, such next length of belt may not come to the secondary transfer roller 21.

In another example configuration shown in FIG. 11, the transfer-fixing belt 13 may have a slack portion between the cleaning roller 23 and secondary transfer roller 21, by which such next length of belt may come to the secondary transfer roller 21.

Accordingly, the transfer-fixing belt 13 may be moved in a substantially normal manner even if the heavy paper HP may enter the fixing nip FN1 in the transfer-fixing unit 12.

Accordingly, a shock jitter may not occur at the primary transfer nip of photoconductor 3 because an effect of load fluctuation at the fixing nip FN1, which may occur when a front edge portion of the sheet P enters the fixing nip FN1, may not be transmitted to the primary transfer nip of photoconductor 3 via the secondary transfer nip N2 and intermediate transfer belt 2.

On one hand, in a conventional art configuration, a load fluctuation occurring at a fixing nip may be transmitted to the primary transfer nip of a photoconductor, by which a shock jitter may occur at the primary transfer nip.

Figure 12:
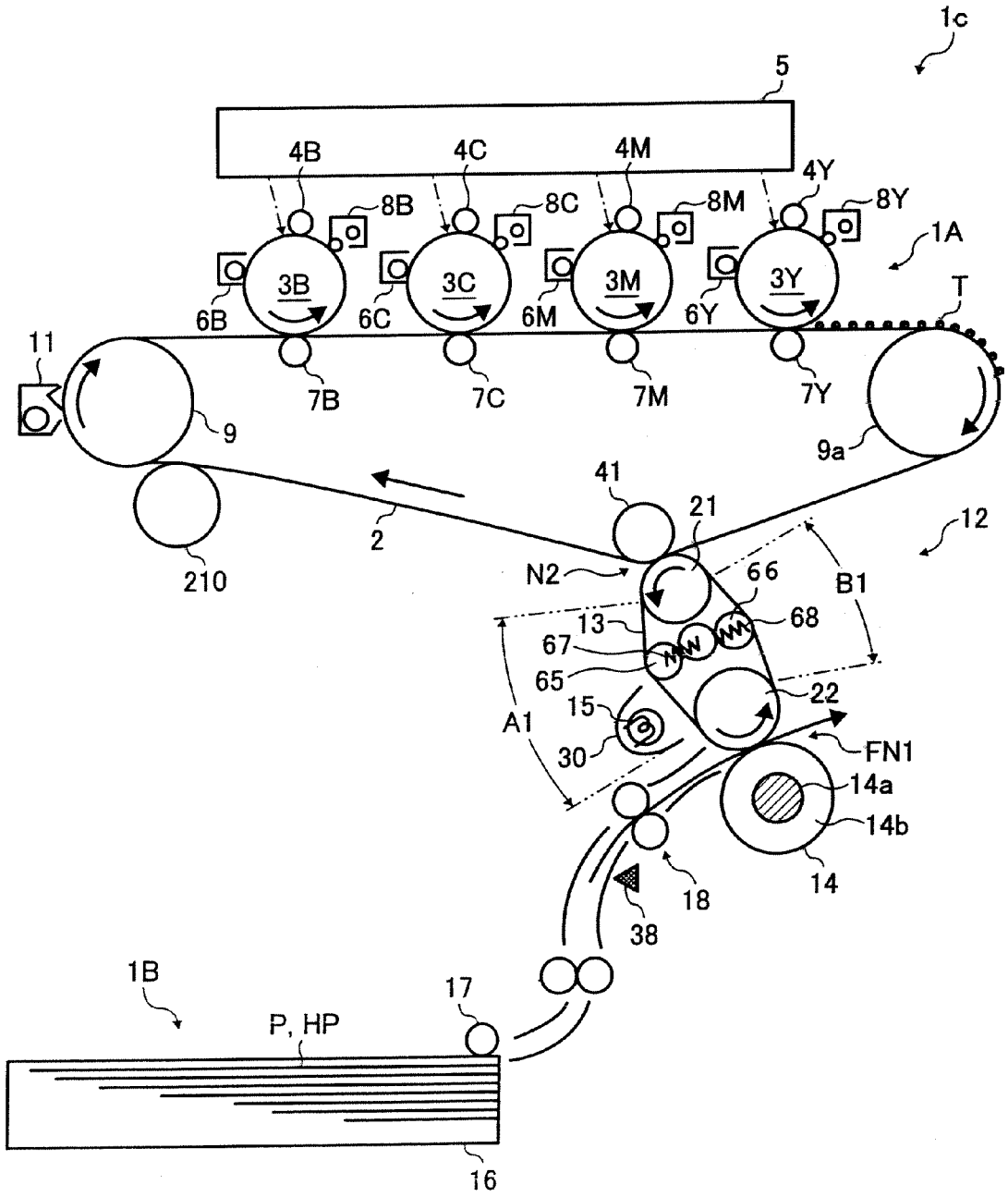
FIG. 12 is another example configuration of an image forming apparatus according to an example embodiment.

FIG. 12 shows another example configuration of an image forming apparatus 1*c* according to an example embodiment. As shown in FIG. 12, the image forming apparatus 1*c* may not include the heat insulating plate 20 shown in FIG. 11.

The image forming apparatus 1*c* shown in FIG. 12 may have a similar configuration of the image forming apparatus 1*b* shown FIG. 11, and similar parts may have similar reference characters or numbers. For example, the transfer-fixing belt 13 may be extended by the secondary transfer roller 21 and transfer-fixing roller 22, and may be moved similarly.

Figure 13A:
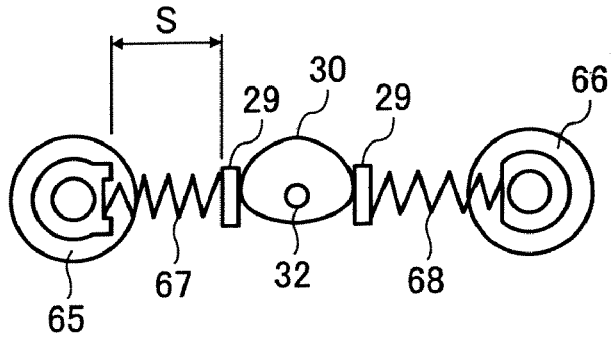
FIGS. 13A to 13C are expanded views of an example configuration for tension applying members in FIG. 12.
Figure 13B:
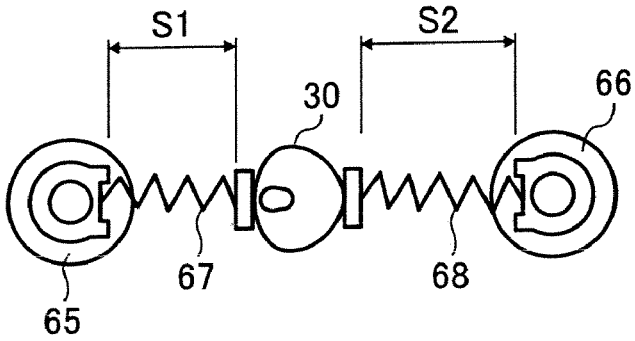
Figure 13C:
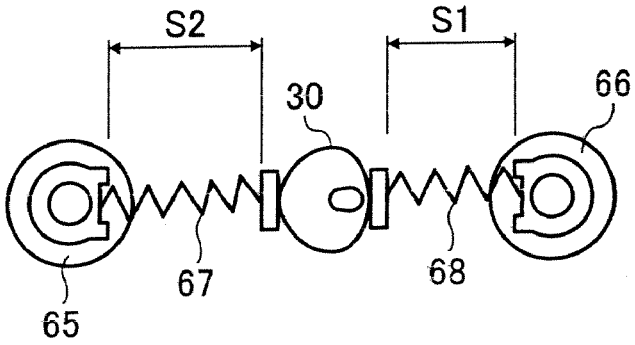

FIGS. 13A-13C show expanded views of an example configuration of a tension applying member used in the image forming apparatus 1*c* shown in FIG. 12.

As shown in FIG. 12, a tension roller 65 may be provided inside the transfer-fixing belt 13 at a zone A1, and a tension roller 66 may be provided inside of the transfer-fixing belt 13 at a zone B1.

The zone A1 may be a zone from the transfer nip N2 to the fixing nip FN1, in which the transfer-fixing belt 13 may travel from the secondary transfer nip N2 to the fixing nip FN1.

The zone B1 may be a zone from the fixing nip FN1 to secondary transfer nip N2 as shown in FIG. 12, in which the transfer-fixing belt 13 may travel from the fixing nip FN1 to the secondary transfer nip N2.

Although not shown, the tension rollers 65 and 66 may include a heat-insulating layer. Accordingly, a heating time for heating a whole of the transfer-fixing unit 12 may be preferably reduced.

The tension rollers 65 and 66 may receive a biasing force from springs 67 and 68, respectively, by which the transfer-fixing belt 13 may be preferably tensioned by the tension rollers 65 and 66.

As shown in FIG. 13A, an end face of springs 67 and 68 may be attached to a contact member 29, which may contact a cam 30. With such configuration, a rotation of the cam 30, with respect to cam center 32, may change a length of the springs 67 and 68.

FIG. 13A shows one condition of tension rollers 65 and 66, and springs 67 and 68.

In FIG. 13A, the spring 67 has a spring length S, which may apply a preferable level of tension force to the transfer-fixing belt 13. Such spring length S may be a relatively shorter length.

Under such a condition, the transfer-fixing belt 13 may be extended with a preferable tension force, and may be driven at a normal manner. Accordingly, the transfer-fixing belt 13 may have a preferable level of traveling stability.

FIG. 13B shows another condition that the cam 30 may rotate in a clockwise direction for 90 degrees with respect to a cam center 32.

In such a condition, a spring length of the spring 27 may become longer than the spring length S, and may have a spring length S1, which is longer than the spring length S.

If the spring length of the spring 67 may change as such during a traveling movement of the transfer-fixing belt 13, a slack portion may be generated on the transfer-fixing belt 13 for a moment at the zone A1 side.

At this condition, a spring length of the spring 68 may become a spring length S2 as shown in FIG. 13B.

A shape of cam 30 may be designed to realize a condition that a spring force of the spring 68 may not change when a condition of the spring 68 changes from FIG. 13A to FIG. 13B when the spring length of the spring 68 becomes the S2 shown in FIG. 13B.

Therefore, the spring 68 may apply a tension force of normal level to the transfer-fixing belt 13 in FIG. 13B, and thereby the transfer-fixing belt 13 may not have a slack portion in the zone B1 side.

FIG. 13C shows another condition that the cam 30 may rotate in a counter-clockwise direction for 90 degrees with respect to the cam center 32.

In such a condition, the transfer-fixing belt 13 may generate a slack portion for a moment in the zone B1 side in a similarly manner explained with FIG. 13B. At this condition, a spring length of the spring 68 may become a spring length S1 and a spring length of the spring 27 may become a spring length S2 as shown in FIG. 13B.

Furthermore, the transfer-fixing belt 13 may have a side guard member (not shown) on each lateral side of the transfer-fixing belt 13 to preferably correct a meandering of transfer-fixing belt 13.

The side guard member having a given thickness may be attached to each lateral side of the transfer-fixing belt 13 with an adhesive material, for example.

Such a side guard member may contact an end portion of rollers (e.g., transfer-fixing roller 22) extending the transfer-fixing belt 13 if a meandering force may occur to the transfer-fixing belt 13.

With such configuration, even if a meandering force may occur to the transfer-fixing belt 13, the transfer-fixing belt 13 may not meander outside of a contact point with rollers (e.g., transfer-fixing roller 22).

Such a configuration may preferably reduce or suppress meandering effect for a belt (e.g., transfer-fixing belt 13), and thereby a buckling or damage may not occur to a belt including a relatively thinner belt.

A controller (not shown) may control the cam 30 to rotate from a condition shown in FIG. 13A to a condition shown in FIG. 13B just before the sheet P (including heavy sheet HP) may leave the fixing nip FN.

For example, a rotation timing of the cam 30 may be determined based on a timing when the sheet thickness sensor 38 detects a sheet thickness.

The sheet thickness sensor 38, provided in front of the registration roller 18, may detect a sheet thickness of sheet P when the sheet P may enter the registration roller 18, and generate a signal for sheet thickness of sheet P.

The controller (not shown) may determine a rotation timing of the cam 30 using a signal-generation timing for sheet thickness of sheet P.

For example, such a rotation timing of the cam 30 may be set to a given time, which is elapsed from the signal-generation timing for sheet thickness detected by the sheet thickness sensor 38.

When the heavy sheet HP may leave the fixing nip FN1, a rotational load of the transfer-fixing roller 22 may be reduced, by which a rotational speed of the transfer-fixing roller 22 may be increased.

In a conventional configuration for transfer-fixing method, the transfer-fixing roller 22 and the secondary transfer roller 21 may have a speed difference when the heavy sheet HP may leave the fixing nip FN1 without adjusting an movement amount of the transfer-fixing belt 13, by which the above-described shock jitter may occur.

In another example configuration according to an example embodiment, a rotational speed of the transfer-fixing roller 22 may be increased for a moment when the heavy sheet HP leaves the fixing nip FN, and thereby the transfer-fixing roller 22 and the secondary transfer roller 21 may have a speed difference.

A movement amount of the transfer-fixing belt 13 by such speed-increased transfer-fixing roller 22 may become greater than a movement amount of the transfer-fixing belt 13 by the normally rotating secondary transfer roller 21.

A slack portion of the transfer-fixing belt 13 in the zone A1 side may adjust (or compensate) a difference of belt movement amount by the transfer-fixing roller 22 and the secondary transfer roller 21.

With such a configuration, a shock jitter may not occur at the primary transfer nip of photoconductor 3 because an effect of load fluctuation at the fixing nip FN1 may not be transmitted to the primary transfer nip of photoconductor 3 via the secondary transfer nip N2 and intermediate transfer belt 2.

In such configuration, a pressure condition at the secondary transfer nip N2 may not be substantially changed over time.

Therefore, the transfer-fixing belt 13 may form an image having preferable image quality on a plurality of sheets continuously even if an interval between the sheets may be short.

Furthermore, the secondary transfer roller 21 and the transfer-fixing roller 22 may be separately driven in the transfer-fixing unit 12. In such configuration, a slack portion of the transfer-fixing belt 13 may be substantially maintained at a stable level, and the transfer-fixing belt 13 may not receive a shock when a tension force is again applied to the transfer-fixing belt 13 by the tension rollers 65 or 66.

Furthermore, the controller (not shown) may control the cam 30 to rotate from a condition shown in FIG. 13A to a condition shown in FIG. 13C just before the sheet P (including heavy sheet HP) may enter the fixing nip FN.

For example, a rotation timing of the cam 30 may be determined based on a timing when the sheet thickness sensor 38 detects a sheet thickness of sheet P.

When a front edge portion of the heavy sheet HP may enter the fixing nip FN1, the cam 30 may rotate in a counter-clockwise direction for 90 degrees with respect to the cam center 32 as shown in FIG. 13C.

In such a condition, a slack portion of the transfer-fixing belt 13 may be generated in the zone B1 for a moment with the above-explained effect of the spring 68 and tension roller 66.

In another example configuration shown in FIG. 12, a rotational speed of the transfer-fixing roller 22 may be decreased for a moment when the heavy sheet HP enters the fixing nip FN1, and thereby the transfer-fixing roller 22 and the secondary transfer roller 21 may have a speed difference.

A movement amount of the transfer-fixing belt 13 by such speed-decreased transfer-fixing roller 22 may become smaller than a movement amount of the transfer-fixing belt 13 by the normally-rotating secondary transfer roller 21.

A slack portion of the transfer-fixing belt 13 in the zone B1 side may adjust (or compensate) a difference of belt movement amount by the transfer-fixing roller 22 and the secondary transfer roller 21.

With such a configuration, a shock jitter may not occur at the primary transfer nip of photoconductor 3 because an effect of load fluctuation at the fixing nip FN1 may not be transmitted to the primary transfer nip of photoconductor 3 via the secondary transfer nip N2 and intermediate transfer belt 2.

A shock jitter may become significant when the heavy sheet HP such as heavy paper is used, but may not become so apparent when a thinner sheet such as plain paper (e.g., less than paper of 70K) is used, for example.

Accordingly, a tension force adjustment process (e.g., tension apply/release) conducted by the springs 67, 68 and the tension rollers 65, 66 may only be conducted when following condition may occur: 1) when the sheet thickness sensor 38 may detect a thicker sheet, or 2) when a user places heavy papers in a sheet tray, for example.

In other words, such tension force adjustment process (e.g., tension apply/release) may not be conducted when a thinner sheet such as plain paper, which may cause little load fluctuation at a fixing nip, is used.

Such an omission of the tension force adjustment process (e.g., tension apply/release) for a thinner sheet may be preferable from a viewpoint of enhancing durability of the transfer-fixing belt 13. Specifically, such omission may preferably reduce unnecessary load to be applied to the transfer-fixing belt 13.

Hereinafter, another example configuration for reducing a shock jitter according to an example embodiment is explained.

Figure 14:
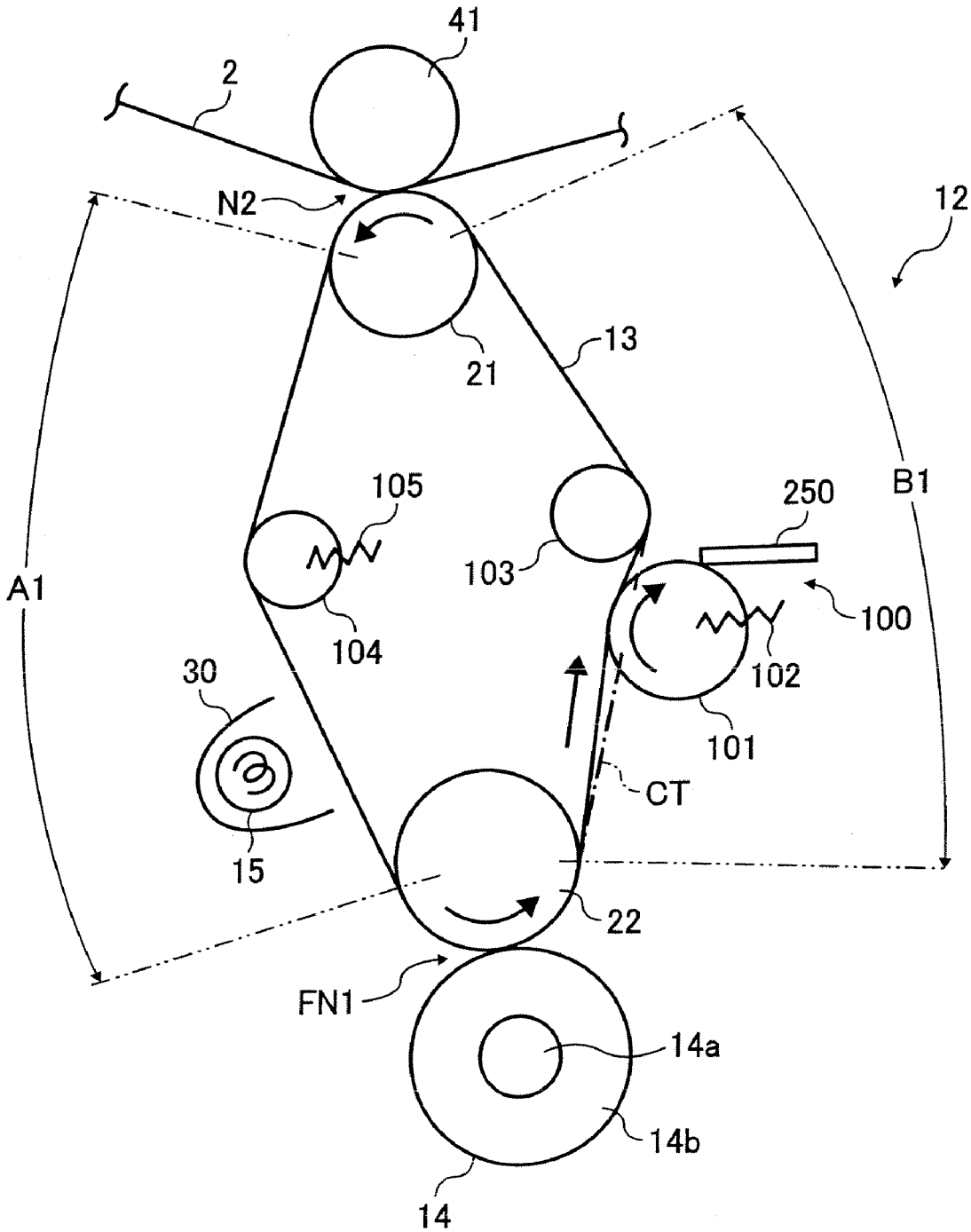
FIG. 14 is another example configuration of transfer-fixing unit according to an example embodiment.

FIG. 14 shows another example configuration of the transfer-fixing unit 12 including the transfer-fixing belt 13.

In the transfer-fixing unit 12 shown in FIG. 14 the transfer-fixing belt 13 may be an endless belt, extended by rollers. A toner image transferred on the transfer-fixing belt 13 may be heated by the heater 15 (e.g., halogen heater). The transfer-fixing belt 13 and pressure roller 14 may define the fixing nip FN1.

The transfer-fixing belt 13 and pressure roller 14 may fix the toner image to a sheet P (as recording medium) when the sheet P passes through the fixing nip FN1 by applying pressure to the sheet P.

Furthermore, as shown in FIG. 14, the transfer-fixing unit 12 may include a tension-applying unit 100.

The tension-applying unit 100 may be provided in the zone B1, in which the transfer-fixing belt 13 may have no toner image because the toner image may have been already transferred to the sheet P at the fixing nip FN1.

As shown in FIG. 14, the tension-applying unit 100 may include a cleaning roller 101, a spring 102, and a cleaning blade 250, for example.

The cleaning roller 101 may rotate with a speed, which may be substantially equal to a traveling speed of the transfer-fixing belt 13.

The cleaning blade 250 may remove a developing agent (e.g., toner particles) remaining on a surface of the cleaning roller 101.

The spring 102 may be operated by a cam mechanism (not shown) to selectively contact the cleaning roller 101 to the transfer-fixing belt 13.

As shown in FIG. 14, the spring 102 may push the cleaning roller 101 so that the cleaning roller 101 may be pushed inside of a common tangent line CT, extending from the tension roller 103 and a transfer-fixing roller 22.

The tension roller 103 may also be used to extend the transfer-fixing belt 13.

With such a pushing effect of the spring 102, the cleaning roller 101 may apply a tension force to the transfer-fixing belt 13.

A tension roller 104 may also be used to extend the transfer-fixing belt 13 as shown in FIG. 14.

The tension roller 104 may be moved in right or left direction in FIG. 14 by an effect of a spring 105 so that a tension force to be applied to the transfer-fixing belt 13 may be adjusted.

The extended transfer-fixing belt 13 may travel in a counter-clockwise direction in FIG. 14 by a rotation of the transfer-fixing roller 22, driven by a drive motor (not shown).

As shown in FIG. 14, the tension roller 103 may be provided in the zone B1, which may be from the fixing nip FN1 to the secondary transfer nip N2.

As shown in FIG. 14, the cleaning roller 101, biased by the spring 102, may contact the transfer-fixing belt 13 between the transfer-fixing roller 22 and tension roller 103.

The cleaning roller 101 (as cleaning member) and spring 102 (biasing member) may be used as a tension applying member to apply a tension force to the transfer-fixing belt 13.

The cleaning roller 101 may include a heat-insulating layer (not shown). Accordingly, a heating time for heating the whole transfer-fixing unit 12 may be preferably reduced.

As similar to the above explained example configurations, the transfer-fixing roller 22 may be used as drive roller, and the transfer-fixing belt 13 may have a slack portion in the zone B1 side.

When an image forming apparatus conducts an image forming operation using a sheet that may not cause a shock jitter, the cleaning roller 101 may apply a tension force to the transfer-fixing belt 13 to maintain the transfer-fixing belt 13 at an extended condition having no slack portion.

A tension force applied by the cleaning roller 101 may be adjusted to a given level depending on types of sheets having different thickness, which may enter the fixing nip FN1. With such tension force adjustment, a tension level of the transfer-fixing belt 13 may be preferably changed depending on types of sheets.

With such a configuration, the transfer-fixing belt 13 may have a slack portion on its belt portion in zone B1, which may be from the fixing nip FN1 to the secondary transfer nip N2.

In such a configuration, the transfer-fixing belt 13 may have such slack portion on a belt portion that may not be used for image forming, and thereby an image quality to be produced may not be affected.

The cleaning roller 101 may be maintained at a given position so that the transfer-fixing belt 13 may be inside the common tangent line CT, extending from the tension roller 103 and transfer-fixing roller 22.

With such positioning of the cleaning roller 101, the cleaning roller 101 may contact with the transfer-fixing belt 13 on a relatively larger contact area, which may be preferable from a viewpoint of enhancing cleaning-ability of the cleaning roller 101 compared to a configuration having a smaller contact area.

Furthermore, toner particles remaining on the transfer-fixing belt 13 may be transferred to the cleaning roller 101, and then may be scraped and recovered by a scraper 250.

As such, the transfer-fixing belt 13 may have a slack portion in the zone B1, which may be from the transfer-fixing roller 22 to cleaning roller 101.

In a normal condition, the transfer-fixing belt 13 may be under a pressure condition, and thereby such slack portion may not be observed in appearance on the transfer-fixing belt 13.

When the heavy sheet HP such as heavy paper may enter the fixing nip FN1, a greater load may be required for a moment to push the transfer-fixing roller 22 and the pressure roller 14, which may apply a relatively higher pressure each other at the fixing nip FN1.

Accordingly, a rotational speed of the transfer-fixing roller 22 may be decreased when the heavy sheet HP may enter the fixing nip FN1.

In another configuration shown in FIG. 14, a rotational speed of the transfer-fixing roller 22 may be decreased for a moment when the heavy sheet HP enters the fixing nip FN1, and thereby the transfer-fixing roller 22 and the secondary transfer roller 21 may have a speed difference.

A movement amount of the transfer-fixing belt 13 by such speed-decreased transfer-fixing roller 22 may become smaller than a movement amount of the transfer-fixing belt 13 by the normally-rotating secondary transfer roller 21.

A slack portion of the transfer-fixing belt 13 in the zone B1 side may adjust (or compensate) for a difference of belt movement amount by the transfer-fixing roller 22 and the secondary transfer roller 21.

With such a configuration, a shock jitter may not occur at the primary transfer nip of photoconductor 3 because an effect of load fluctuation at the fixing nip FN1 may not be transmitted to the primary transfer nip of photoconductor 3 via the secondary transfer nip N2 and intermediate transfer belt 2.

Such a movement adjustment (compensation) may be conducted between the transfer-fixing roller 22 and tension roller 103, by which a traveling movement of the transfer-fixing belt 13 from the tension roller 103 to the secondary transfer roller 21 may be regulated.

Specifically, when the cleaning roller 101 may be moved to a right direction in FIG. 14, which is opposite to a pressuring direction of cleaning roller 101, a slack portion may be generated on a belt portion from the transfer-fixing roller 22 to cleaning roller 101.

When such a slack portion may be generated, a belt portion of the transfer-fixing belt 13 between the tension roller 103 and secondary transfer roller 21 may not be pulled by a belt portion of the transfer-fixing belt 13 between the tension roller 103 and transfer fixing roller 22, by which a load fluctuation at the fixing nip FN1 may not be transmitted to the secondary transfer nip N2.

As such, a speed fluctuation of the transfer-fixing belt 13, which may occur when the heavy sheet HP may enter the fixing nip FN1, may be adjusted (or compensated) by a slack portion of the transfer-fixing belt 13.

With such a configuration, a speed fluctuation of the transfer-fixing belt 13 may not be transmitted to the primary transfer nip of photoconductor 3 via the secondary transfer nip N2 and intermediate transfer belt 2.

Therefore, a shock jitter, which may occur when a front edge portion of sheet P enters the fixing nip FN1, may be preferably reduced or suppressed.

On one hand, in a conventional art configuration, a speed fluctuation of the transfer-fixing belt 13 may be transmitted to the primary transfer nip of photoconductor 3 via the secondary transfer nip N2 and intermediate transfer belt 2, by which a shock jitter may occur at the primary transfer nip of photoconductor 3.

The transfer-fixing belt 13 may be applied with a preferable tension force in the zone A1, which may be from the secondary transfer nip N2 to fixing nip FN1, by the tension roller 104. The tension roller 104 may be biased by the spring 105.

Although not shown, the tension roller 104 may include a heat-insulating layer. Accordingly, a heating time for heating a whole of the transfer-fixing unit 12 may be preferably reduced.

Under such a condition, the transfer-fixing belt 13, extended with a preferable tension force, may be driven at a normal manner. Accordingly, the transfer-fixing belt 13 may have a preferable level of traveling stability.

A rotational speed of the transfer-fixing roller 22 may be increased for a moment when the heavy sheet HP leaves the fixing nip FN, and thereby the transfer-fixing roller 22 and the secondary transfer roller 21 may have a speed difference.

A movement amount of the transfer-fixing belt 13 by such speed-increased transfer-fixing roller 22 may become greater than a movement amount of the transfer-fixing belt 13 by the normally-rotating secondary transfer roller 21.

Under such a condition, the transfer-fixing belt 13 may be extended with a tension force, which may set a preferable level of slack portion on the transfer-fixing belt 13 in the zone A1 side.

Such slack portion of the transfer-fixing belt 13 in the zone A1 side may adjust (or compensate) a difference of belt movement amount by the transfer-fixing roller 22 and the secondary transfer roller 21.

With such a configuration, a shock jitter may not occur at the primary transfer nip of photoconductor 3 because an effect of load fluctuation at the fixing nip FN1 may not be transmitted to the primary transfer nip of photoconductor 3 via the secondary transfer nip N2 and intermediate transfer belt 2.

In such a configuration, a pressure condition at the secondary transfer nip N2 may not be substantially changed. Therefore, the transfer-fixing belt 13 may form an image having preferable quality on a plurality of sheets continuously even if an interval between the sheets may be short.

Furthermore, the secondary transfer roller 21 and the transfer-fixing roller 22 may be separately driven in the transfer-fixing unit 12. In such configuration, a slack portion of the transfer-fixing belt 13 may be substantially maintained at a stable level, and the transfer-fixing belt 13 may not receive a shock when a tension force is again applied to the transfer-fixing belt 13 by a roller such as cleaning roller 101.

If a configuration shown in FIG. 14 may not be effective for reducing a shock jitter depending on types of heavy sheet, another configuration using a cam configuration shown in FIG. 13 may be employed, for example.

In the above-explained configuration, the cleaning roller 101 may include a heat-insulating layer. Instead of such heat-insulating layer, the cleaning roller 101 may include a following configuration.

For example, the cleaning roller 101 may have a heat pipe configuration to reduce or suppress a temperature-increase of the transfer-fixing belt 13, or a temperature-increase around the photoconductor 3 to maintain an image quality at a given preferable level. Furthermore, the cleaning roller 101 may have a heat pipe configuration to maintain a preferable cleaning-ability, which may be matched to an imager forming apparatus configuration or toner type.

The cleaning roller 101 may be configured to selectively contact the transfer-fixing belt 13.

The transfer-fixing belt 13 may be configured to continuously contact a member such as cleaning roller 101, which may be preferable from a viewpoint of decreasing a temperature of the transfer-fixing belt 13. However, such continuous contacting configuration may need a relatively greater amount of power to maintain a temperature of the transfer-fixing belt 13.

Accordingly, when an image forming apparatus is in non-performing condition, it is preferable to reduce a contacting between the transfer-fixing belt 13 and a member such as cleaning roller 101. The non-performing condition may include a warming-up period, and process unit adjustment period, or the like.

In other words, it is preferable to maintain a non-contact condition of the transfer-fixing belt 13 when an image forming apparatus is not in actual image forming operation.

Therefore, when an image forming apparatus may come to an adjustment period of image processing units, the cleaning roller 101 may preferably not be in contact with the transfer-fixing belt 13, and when the image forming apparatus comes to an actual image forming operation, the cleaning roller 101 may be preferably contacted to the transfer-fixing belt 13.

Furthermore, a contact-type temperature sensor (not shown) may be used to detect a temperature of the transfer-fixing belt 13, which may be heated to a given operating temperature by a heater.

Until a temperature of the transfer-fixing belt 13 may reach such given operating temperature, the cleaning roller 101 may preferably not be in contact with the transfer-fixing belt 13. The contact-type temperature sensor may be used to detect such given operating temperature.

With such configuration, an energy consumption of an image forming apparatus may be reduced, and thereby an image forming apparatus may have an enhanced energy saving function.

Figure 15:
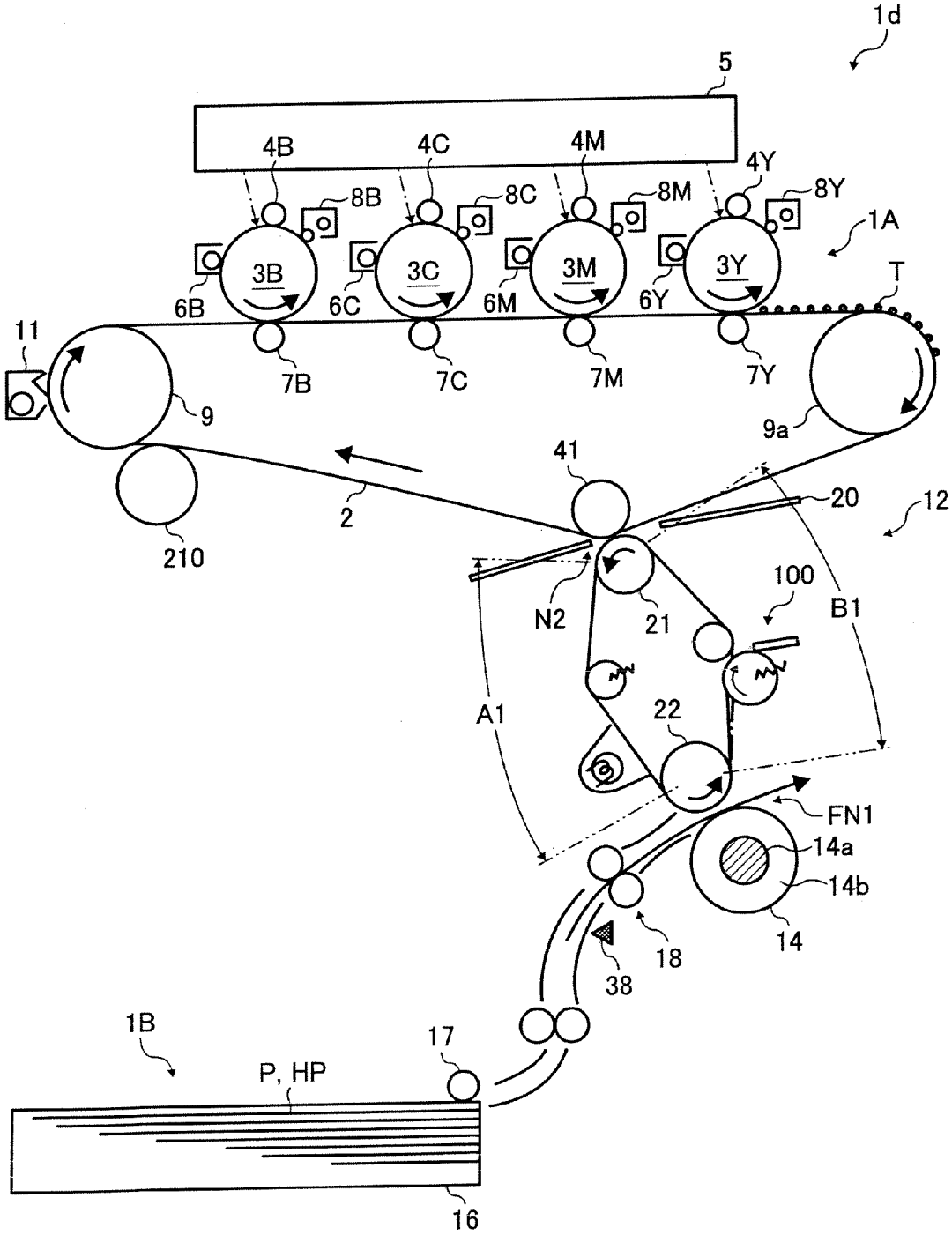
FIG. 15 is another example configuration of an image forming apparatus according to an example embodiment, in which a transfer-fixing unit shown in FIG. 14 is provided.

FIG. 15 shows another example configuration of an image forming apparatus id modified from the image forming apparatus 1*b* in FIG. 11.

Specifically, the image forming apparatus id may include the transfer-fixing unit 12 shown in FIG. 14 instead of the transfer-fixing unit 12 shown in FIG. 11.

Figure 16:
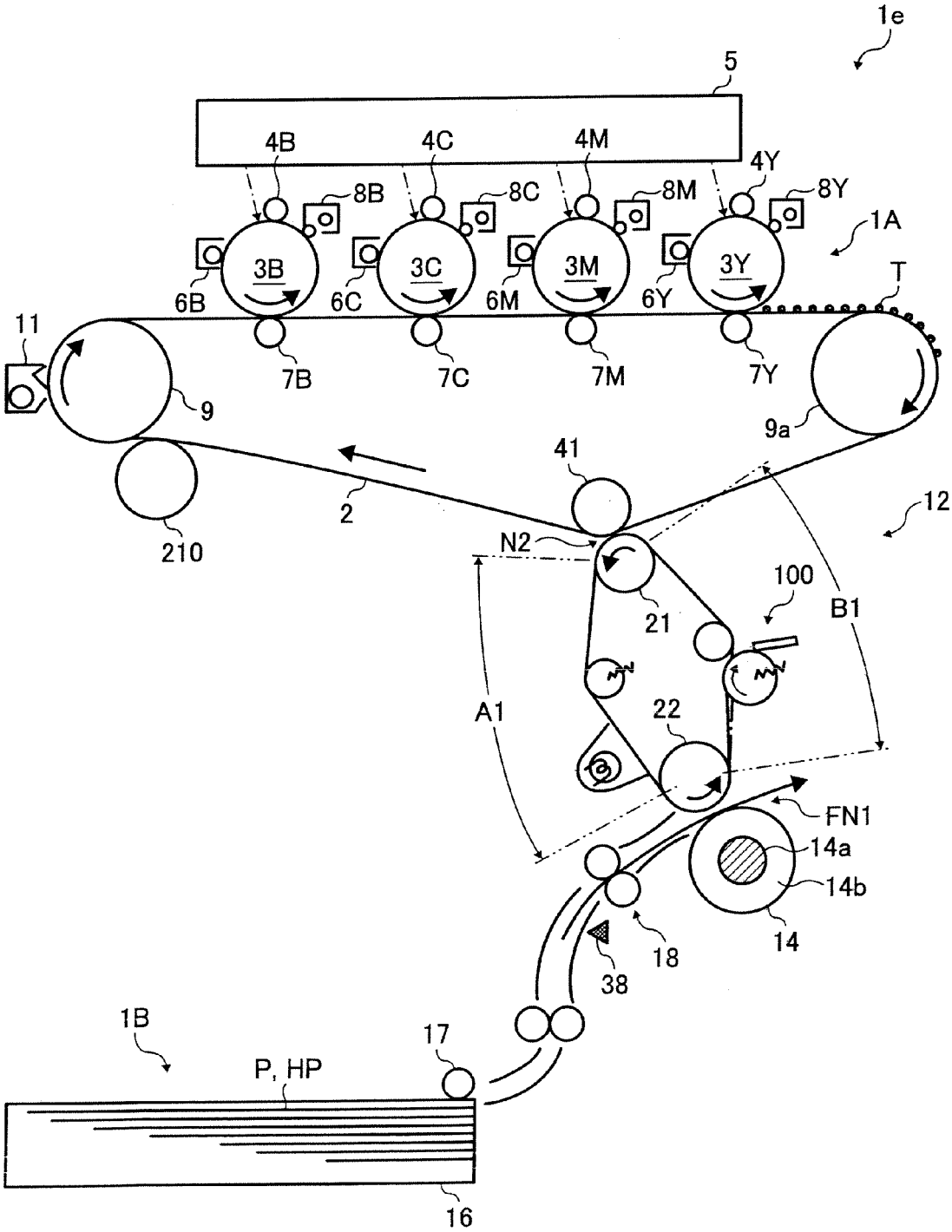
FIG. 16 is another example configuration of an image forming apparatus according to an example embodiment, in which a transfer-fixing unit shown in FIG. 14 is provided.

FIG. 16 shows another example configuration of an image forming apparatus 1*e* modified from the image forming apparatus 1*b* in FIG. 12.

Specifically, the image forming apparatus 1*e* may include the transfer-fixing unit 12 shown in FIG. 14 instead of the transfer-fixing unit 12 shown in FIG. 12.

In the above-discussed example configurations according to an example embodiment, an image forming apparatus having an intermediate transfer belt is explained, in which the transfer-fixing belt 13 may not directly contact the photoconductor 3.

Figure 17:
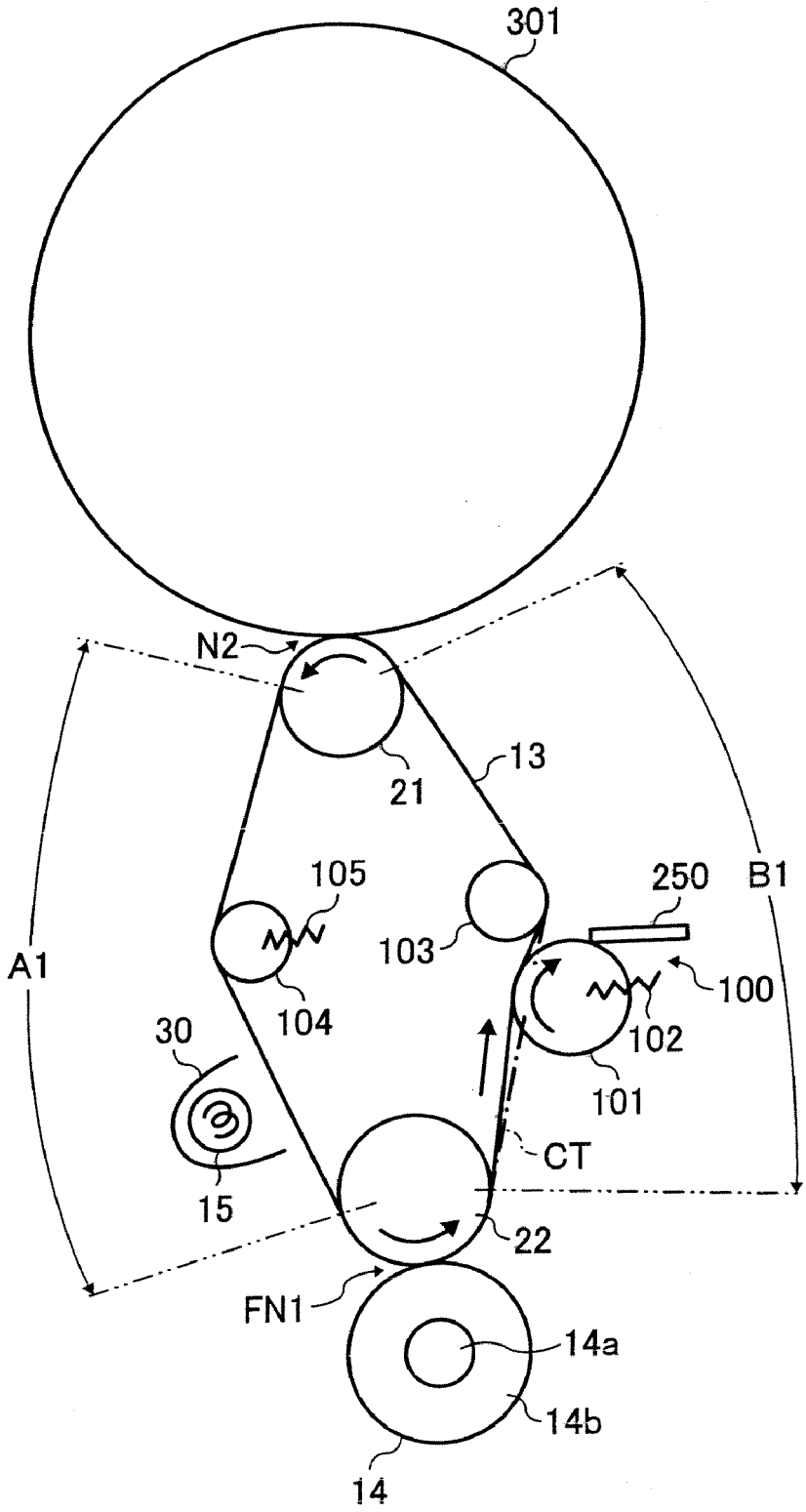
FIG. 17 is another example configuration of an image forming apparatus according to an example embodiment, in which a transfer-fixing unit shown in FIG. 14 is provided.
Figure 18:
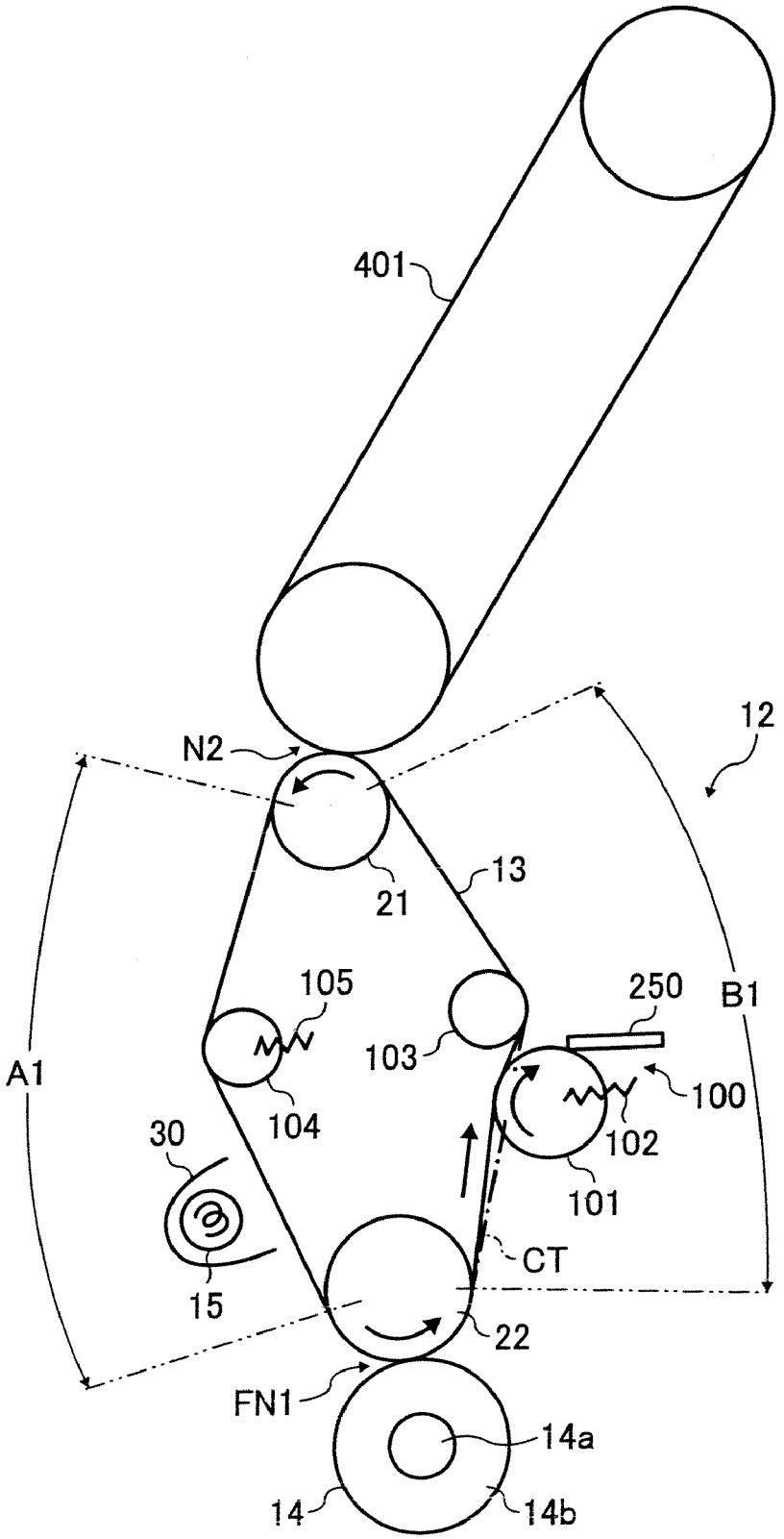
FIG. 18 is another example configuration of an image forming apparatus according to an example embodiment, in which a transfer-fixing unit shown in FIG. 14 is provided according to an example embodiment.

However, the transfer-fixing belt 13 can directly contact a photoconductor as shown in FIGS. 17 and 18.

A direct contact configuration shown in FIGS. 17 and 18 may have a similar effect for reducing a shock jitter as in previous example configurations explained in the above.

Accordingly, an image forming apparatus configuration using a transfer-fixing method according to example embodiment may include an intermediate transfer belt type and also a direct contact type.

Hereinafter, such direct contact type is explained with FIGS. 17 and 18.

FIG. 17 shows a schematic configuration of an image forming apparatus employing the transfer-fixing unit 12 shown in FIG. 14.

Such image forming apparatus may include a photoconductor drum 301 and the transfer-fixing belt 13, which may directly contact each other. In such a configuration, a toner image may be transferred from the photoconductor drum 301 to the transfer-fixing belt 13 directly.

FIG. 18 shows a schematic configuration of an image forming apparatus employing the transfer-fixing unit 12 shown in FIG. 14.

Such image forming apparatus may include a photoconductor belt 401 and the transfer-fixing belt 13, which may directly contact each other. In such configuration, a toner image may be transferred from the photoconductor belt 401 to the transfer-fixing belt 13 directly.

In example configurations shown in FIGS. 17 and 18, the cleaning roller 101 may be maintained at a given position so that the transfer-fixing belt 13 may be inside the common tangent line CT of the tension roller 103 and transfer-fixing roller 22.

With such positioning of the cleaning roller 101, the cleaning roller 101 may be in contact with the transfer-fixing belt 13 on a relatively larger contact area, which may be preferable from a viewpoint of enhancing cleaning-ability of the cleaning roller 101 compared to a configuration having a smaller contact area.

The cleaning-ability may mean that a cleaning level of toner particles, which may be removed from the transfer-fixing belt 13 by the cleaning roller 101.

With such a relatively larger contact area, the cleaning roller 101 may preferably clean the transfer-fixing belt 13 even if a speed difference may not be set between the transfer-fixing belt 13 and cleaning roller 101. For example, the transfer-fixing belt 13 and cleaning roller 101 may have a substantially similar speed.

If the transfer-fixing belt 13 and cleaning roller 101 may have a substantially similar speed, a frictional degradation of cleaning roller 101 and transfer-fixing belt 13 due to a speed difference may be reduced or suppressed, which may be preferable from a viewpoint of extending a life time of parts and reducing apparatus cost.

Furthermore, the cleaning roller 101 may have a different cleaning-ability depending on an image forming apparatus configuration or toner type. In such a case, the transfer-fixing belt 13 and cleaning roller 101 may also be set to have a somewhat different speed, as required.

Hereinafter, a toner shape according to an example embodiment is explained.

A level of transferability (e.g., efficiency and effectiveness of transfer) of toner particles from the intermediate transfer belt 2 to the transfer-fixing belt 13 may affect an image quality. For example, a good transferability of toner particles may result in a higher image quality. It is known that such transferability of toner may be influenced by toner shape.

In this disclosure, a toner shape may be set to a preferable given shape, which may produce a higher image quality in an image forming apparatus according to the above-described example embodiment.

In this disclosure, toner particles may have a Wardell sphericity ($\phi$) of 0.8 or more, for example, to produce a higher image quality, wherein toner having Wardell sphericity ($\phi$) of 0.8 or more may have been used for enhancing transferability of toner.

Such toner having Wardell sphericity ($\phi$) of 0.8 or more may enhance transferability of secondary transfer, and effectiveness of image transfer, by which a higher image quality may be obtained.

The Wardell sphericity ($\phi$) may be expressed as below:

$\phi$=(diameter of circle, which is equal to projected are of particle)/(diameter of circle, which is circumscribed a projected are of particle)

The Wardell sphericity ($\phi$) may be measured as below. For example, a given amount of toners may be put on a slide glass. Then, toners may be observed with a microscope having magnification power of 500 times. Then, a dimension of 100 toner particles may be measured to compute the Wardell sphericity ($\phi$).

The above-explained configurations according to an example embodiment may preferably reduce a shock jitter at a primary transfer nip, which may be caused by the transfer-fixing unit and intermediate transfer member (e.g., intermediate transfer belt 2).

Accordingly, an image forming apparatus according to the example embodiment may produce a higher quality image, which may not be affected by such shock jitter. For example, such image forming apparatus may include a digital printer, which may produce a higher quality image such as 600 dpi (dot per inch) or more.

Numerous additional modifications and variations are possible in light of the above teachings. It is therefore to be understood that within the scope of the appended claims, the disclosure of the present invention may be practiced otherwise than as specifically described herein.

What is claimed is:

1. A transfer unit for use in an image forming apparatus, comprising:

a transfer belt, having a given circumferential length, configured to receive an un-fixed image formed of an image developer from an image carrier at a first nip, the first nip being defined between the transfer belt and the image carrier; and a counter member configured to face the transfer belt to form a second nip with the transfer belt, the un-fixed image being transferred from the transfer belt to a recording medium passing through the second nip, wherein a slack portion is generated in the transfer belt when a front edge of the recording medium passes through the second nip, the slack portion of the transfer belt being generated in a first portion of the transfer belt returning from the second nip to the first nip.

2. The transfer unit according to claim 1, further comprising:

a rotatable member configured to be contactable on the first portion of the transfer belt, and to rotate at a speed that is faster than a circumferential velocity of the transfer belt.

3. The transfer unit according to claim 2, wherein the rotatable member is further configured to remove the image developer remaining on a surface of the transfer belt.

4. An image forming apparatus, comprising:

a transfer unit including a transfer belt, having a given circumferential length, configured to receive an un-fixed image formed of an image developer from an image carrier at a first nip, the first nip being defined between the transfer belt and the image carrier;

a counter member configured to face the transfer belt to form a second nip with the transfer belt, the un-fixed image being transferred from the transfer belt to a recording medium passing through the second nip, wherein a slack portion is generated in the transfer belt when a front edge of the recording medium passes through the second nip, the slack portion of the transfer belt being generated in a first portion of the transfer belt returning from the second nip to the first nip; and a rotatable member configured to be contactable on the first portion of the transfer belt, and to rotate at a speed that is faster than a circumferential velocity of the transfer belt;

an ejection roller configured to sandwich the recording medium passing through the second nip and to eject the recording medium which has passed through the second nip; and a rotation controller, linked to the ejection roller, configured to control a rotational speed of the ejection roller.

5. The image forming apparatus according to claim 4, wherein the rotation controller is configured to control the ejection roller to rotate at a given rotational speed, in which the rotation controller gradually decreases the rotational speed of the ejection roller from the given rotational speed, and then gradually increases the rotational speed of the ejection roller to the given rotational speed.

6. The image forming apparatus according to claim 4, further comprising:

a timing detector configured to detect a pass-through timing of a rear edge portion of the recording medium at the second nip, wherein the rotational speed of the ejection roller is controlled based on a detection result of the timing detector.

7. The image forming apparatus according to claim 6, wherein the timing detector is configured to determine when to transport a front edge portion of the recording medium to the second nip.

8. The image forming apparatus according to claim 4, further comprising:

a thickness detector configured to detect a thickness of the recording medium, wherein the rotational speed of the ejection roller is controlled based on a detection result of the thickness detector.

9. The transfer unit according to claim 1, further comprising:

a tension applying member provided on the first portion of the transfer belt, wherein the tension applying member is configured to decrease a tension force applied to the transfer belt when a front edge portion of the recording medium passes through the second nip so that the transfer belt generates a slack portion.

10. The transfer unit according to claim 9, further comprising:

a thickness detector configured to detect a thickness of the recording medium, wherein the tension applying member is configured to decrease a tension applied to the transfer belt when the thickness detector detects that a front edge portion or a rear edge portion of the recording medium, having a given thickness, passes through the second nip, and wherein the thickness detector detects the given thickness of the recording medium.

11. The transfer unit according to claim 9, wherein the tension applying member is further configured to remove the image developer remaining on a surface of the transfer belt, and the tension applying member includes a cleaning roller.

12. The transfer unit according to claim 3, further comprising:

a heater configured to heat the un-fixed image on the transfer belt, and wherein the rotatable member includes a heat-insulating layer.

13. The transfer unit according to claim 9, further comprising:

a heater configured to heat the un-fixed image on the transfer belt, and wherein the tension applying member includes a tension roller having a heat-insulating layer.

14. The transfer unit according to claim 3, further comprising:

a heater configured to heat the un-fixed image on the transfer belt, and wherein the rotatable member is further configured to selectively contact the transfer belt.

15. The transfer unit according to claim 2, further comprising:

a heater configured to heat the un-fixed image on the transfer belt, and wherein the rotatable member includes a heat pipe structure.

16. An image forming apparatus, comprising:

a transfer unit, comprising:

a transfer belt, having a given circumferential length, configured to receive an un-fixed image formed of an image developer from an image carrier at a first nip, the first nip being defined between the transfer belt and the image carrier; and a counter member configured to face the transfer belt to form a second nip with the transfer belt, the un-fixed image being transferred from the transfer belt to a recording medium passing through the second nip, wherein a slack portion is generated in the transfer belt when a front edge of the recording medium passes through the second nip, the slack portion of the transfer belt being generated in a first portion of the transfer belt returning from the second nip to the first nip.

17. The image forming apparatus according to claim 16, further comprising:

a heater configured to heat the un-fixed image on the transfer belt.

18. The image forming apparatus according to claim 16, further comprising:

a heater configured to heat the un-fixed image on the transfer belt, and wherein the image carrier includes an intermediate transfer belt.

19. The image forming apparatus according to claim 16, further comprising:

a heater configured to heat the un-fixed image on the transfer belt, and wherein the image carrier includes an intermediate transfer belt, and the counter member includes a pressure roller.

20. The image forming apparatus according to claim 16, further comprising:

a heater configured to heat the un-fixed image on the transfer belt, and wherein the image carrier includes a photoconductor.

* * * * *